US010547117B1

(12) United States Patent
Tomasic et al.

(10) Patent No.: US 10,547,117 B1
(45) Date of Patent: Jan. 28, 2020

(54) MILLIMETER WAVE, WIDEBAND, WIDE SCAN PHASED ARRAY ARCHITECTURE FOR RADIATING CIRCULAR POLARIZATION AT HIGH POWER LEVELS

(71) Applicant: Government of the United States, as represented by the Secretary of the Air Force, Wright-Patterson AFB, OH (US)

(72) Inventors: Boris Tomasic, Harvard, MA (US); Carl R. Pfeiffer, Beavercreek, OH (US); Thomas P. Steffen, Xenia, OH (US)

(73) Assignee: Unites States of America as represented by the Secretary of the Air Force, Wright-Patterson AFB, OH (US)

( * ) Notice: Subject to any disclaimer, the term of this patent is extended or adjusted under 35 U.S.C. 154(b) by 0 days.

(21) Appl. No.: 16/201,181

(22) Filed: Nov. 27, 2018

Related U.S. Application Data

(60) Provisional application No. 62/594,804, filed on Dec. 5, 2017, provisional application No. 62/594,735, filed on Dec. 5, 2017.

(51) Int. Cl.
*H01Q 15/24* (2006.01)

(52) U.S. Cl.
CPC ..... *H01Q 15/24* (2013.01)

(58) Field of Classification Search
CPC ..... H01Q 15/24
USPC ..... 343/700 MS
See application file for complete search history.

(56) References Cited

U.S. PATENT DOCUMENTS

| | | | |
|---|---|---|---|
| 3,603,987 | A | 9/1971 | Witte |
| 3,681,769 | A | 8/1972 | Perrotti |
| 3,754,271 | A | 8/1973 | Epis |
| 3,857,112 | A | 12/1974 | Epis |
| 4,156,213 | A | 5/1979 | Shindo |
| 4,228,410 | A | 10/1980 | Goudey |
| 4,266,203 | A | 5/1981 | Saudreau |
| 4,479,128 | A | 10/1984 | Brunner |
| 4,652,886 | A | 3/1987 | Rosser |
| 4,903,033 | A | 2/1990 | Tsao |
| 5,258,768 | A | 11/1993 | Smith |
| 5,434,587 | A | 7/1995 | Hannan |
| 5,453,751 | A | 9/1995 | Tsukamoto |
| 5,502,453 | A | 3/1996 | Tsukamoto |
| 5,596,336 | A | 1/1997 | Liu |
| 5,663,683 | A | 9/1997 | McCandless |
| 5,793,330 | A | 8/1998 | Gans |

(Continued)

OTHER PUBLICATIONS

L. Young, L. Robinson and C. Hacking, "Meander-line polarizer," IEEE Trans. on Antenn. and Propag., vol. 21, pp. 376-378, 1973.

(Continued)

*Primary Examiner* — Andrea Lindgren Baltzell
(74) *Attorney, Agent, or Firm* — AFMCLO/JAZ

(57) ABSTRACT

An active electronically scanned array (AESA) is disclosed. The AESA includes a linear-to-circular polarizer coupled to a radiating aperture and one or more transmit-receive modules coupled to radiating elements and a liquid cooling manifold having a plurality of distributed liquid cooling ducts disposed adjacent the one or more transmit-receive modules to provide cooling of the AESA during high-power operation.

19 Claims, 30 Drawing Sheets

(56) References Cited

U.S. PATENT DOCUMENTS

| | | | | |
|---|---|---|---|---|
| 5,880,694 | A | 3/1999 | Wang | |
| 6,054,967 | A | 4/2000 | Wu | |
| 6,133,888 | A | 10/2000 | Mohuchy | |
| 6,175,449 | B1 | 1/2001 | Menzel | |
| 6,356,164 | B1 * | 3/2002 | Rowatt | H01P 1/18 333/21 A |
| 6,421,012 | B1 | 7/2002 | Heckaman | |
| 6,650,291 | B1 | 11/2003 | West | |
| 6,870,511 | B2 | 3/2005 | Lynch | |
| 6,900,765 | B2 | 5/2005 | Navarro | |
| 6,940,458 | B2 | 9/2005 | Mukai | |
| 6,963,253 | B2 | 11/2005 | Kovac | |
| 7,092,255 | B2 | 8/2006 | Barson | |
| 7,170,446 | B1 | 1/2007 | West | |
| 7,187,342 | B2 | 3/2007 | Heisen | |
| 7,212,087 | B2 | 5/2007 | Nagai | |
| 7,414,491 | B2 | 8/2008 | Higgins | |
| 7,417,598 | B2 | 8/2008 | Navarro | |
| 7,443,354 | B2 | 10/2008 | Navarro | |
| 7,508,338 | B2 | 3/2009 | Pluymers | |
| 7,564,419 | B1 | 7/2009 | Patel | |
| 7,772,939 | B2 | 8/2010 | Watanabe | |
| 7,808,337 | B2 | 10/2010 | Rosenberg | |
| 7,940,524 | B2 | 5/2011 | Rummel | |
| 7,952,531 | B2 | 5/2011 | Liu | |
| 8,182,103 | B1 | 5/2012 | Brown | |
| 8,248,322 | B1 | 8/2012 | Patel | |
| 8,305,157 | B2 | 11/2012 | Lee | |
| 8,363,413 | B2 | 1/2013 | Paquette | |
| 8,917,149 | B2 | 12/2014 | Blech | |
| 9,035,848 | B2 | 5/2015 | Infante | |
| 9,147,921 | B2 | 9/2015 | Delgado | |
| 9,257,734 | B2 | 2/2016 | Hoover | |
| 9,287,632 | B2 | 3/2016 | Manry | |
| 9,559,424 | B2 | 1/2017 | Nelson | |
| 9,735,475 | B2 | 8/2017 | Anderson | |
| 9,887,458 | B2 | 2/2018 | Legay | |
| 9,941,594 | B2 | 4/2018 | Milroy | |
| 2002/0163469 | A1 | 11/2002 | Waterman | |
| 2002/0167449 | A1 | 11/2002 | Frazita | |
| 2004/0032305 | A1 | 2/2004 | Bohnet | |
| 2004/0252059 | A1 | 12/2004 | Zaghloul | |
| 2005/0062661 | A1 | 3/2005 | Zagiiloul | |
| 2005/0104791 | A1 | 5/2005 | Sun | |
| 2006/0066414 | A1 | 3/2006 | Higgins | |
| 2006/0268518 | A1 | 11/2006 | Edward | |
| 2007/0046547 | A1 | 3/2007 | Crouch | |
| 2007/0152882 | A1 | 7/2007 | Hash | |
| 2012/0268818 | A1 | 10/2012 | Liu | |
| 2012/0307361 | A1 | 12/2012 | Liu | |
| 2013/0082893 | A1 | 4/2013 | Wang | |
| 2013/0214984 | A1 | 8/2013 | Zaghloul | |
| 2013/0249755 | A1 * | 9/2013 | Sanchez | H01Q 15/244 343/756 |
| 2015/0015440 | A1 | 1/2015 | Montgomery | |
| 2015/0022409 | A1 | 1/2015 | Milroy | |
| 2015/0222022 | A1 | 8/2015 | Kundtz | |
| 2015/0349431 | A1 | 12/2015 | Odes | |
| 2016/0172732 | A1 * | 6/2016 | Adams | H01P 1/172 333/21 A |
| 2016/0218412 | A1 | 7/2016 | Day | |
| 2016/0372820 | A1 | 12/2016 | Collignon | |
| 2017/0099041 | A1 | 4/2017 | Wall | |
| 2017/0179612 | A1 | 6/2017 | Kamgaing | |
| 2017/0264011 | A1 | 9/2017 | Kim | |
| 2018/0024226 | A1 | 1/2018 | Izadian | |
| 2018/0076521 | A1 | 3/2018 | Mehdipour | |
| 2018/0131100 | A1 | 5/2018 | Ouyang | |

OTHER PUBLICATIONS

B. A. Munk, Finite antenna arrays and FSS, John Wiley & Sons, 2003.

S. Pancharatnam, "Achromatic combinations of birefringent plates," The Proceedings of the Indian Academy of Sciences, vol. 41, pp. 137-144, 1955.

J.-B. Masson and G. Gallot, "Terahertz achromatic quarter-wave plate," Optics Lett., vol. 31, pp. 265-267, 2006.

G. Pisano, G. Savini, P. A. R. Ade, V. Haynes and W. K. Gear, "Achromatic half-wave plate for submillimeter instruments in cosmic microwave background astronomy: experimental characterization," Applied Optics, vol. 45, pp. 6982-6989, 2006.

C. Pfeiffer and A. Grbic, "Millimeter-wave transmitarrays for wavefront and polarization control," IEEE Trans. on Microwave Theory and Techniques, vol. 61, pp. 4407-4417, 2013.

S. M. A. M. H. Abadi and N. Behdad, "Wideband linear-to-circular polarization converters based on miniaturized-element frequency selective surfaces," IEEE Trans. on Antenn. and Propag., vol. 64, pp. 525-534, 2016.

D. Lerner, "A wave polarization converter for circular polarization," IEEE Trans. on Antenn. and Propag., vol. 13, pp. 3-7, 1965.

R.-S. Chu and K.-M. Lee, "Analytical model of a multilayered meander-line polarizer plate with normal and oblique plane-wave incidence," IEEE Trans. on Antenn. and Propag., vol. 35, pp. 652-661, 1987.

A. Ludwig, "The definition of cross polarization," IEEE Transactions on Antennas and Propagation, vol. 21, pp. 116-119, 1973.

C. Pfeiffer and A. Grbic, "Emulating Nonreciprocity with Spatially Dispersive Metasurfaces Excited at Oblique Incidence," Phys. Rev. Lett., vol. 117, p. 077401, 2016.

K. F. Brakora, J. Halloran and K. Sarabandi, "Design of 3-D monolithic MMW antennas using ceramic stereolithography," IEEE Trans. on Antenn. and Propag., vol. 55, No. 3, pp. 790-797, 2007.

X. Chen, T. M. Grzegorczyk, B.-I. Wu, J. Pacheco Jr and J. A. Kong, "Robust method to retrieve the constitutive effective parameters of metamaterials," Phys. Rev. E, vol. 70, p. 016608, 2004.

C. Pfeiffer and A. Grbic, "Bianisotropic metasurfaces for optimal polarization control: Analysis and synthesis," Phys. Rev. Applied, vol. 2, p. 044011, 2014.

P. F. Goldsmith, "Quasi-optical techniques," Proceedings of the IEEE, vol. 80, pp. 1729-1747, 1992.

D. H. Schaubert, S. Kasturi, A. O. Boryssenko and W. M. Elsallal, "Vivaldi antenna arrays for wide bandwidth and electronic scanning," in European Conference on Antennas and Propagation, Edinburgh, UK, 2007.

T. Kamgaing, A. A. Elsherbini, S. N. Oster, B. M. Rawlings and K.-O. Lee, "Ultra-thin dual polarized millimeter-wave phased array system-in-package with embedded transceiver chip," IEEE MTT-S International Microwave Symposium (IMS), 2015.

R. J. Bolt, D. Cavallo, G. Gerini, D. Deurloo, R. Grooters, A. Neto and G. Toso, "Characterization of a dual-polarized connected-dipole array for Ku-band mobile terminals," IEEE Transactions on Antennas and Propagation, vol. 64, pp. 591-598, 2016.

Bjorn J. Doring, "Cooling system fora Ka band transmit antenna array," Institute of Communications and Navigation, Thesis submitted to Technical University Berlin on Dec. 19, 2005.

R. W. Kindt and W. R. Pickles, "Ultrawideband all-metal flared-notch array radiator," IEEE Transactions on Antennas and Propagation, vol. 8, pp. 3568-3575, 2010.

S. Livingston and J. J. Lee, "Evolution of wide band array designs," IEEE International Symposium on Antennas and Propagation (APSURSI), pp. 1957-1960, 2011.

A. Jam and K. Sarabandi, "A horizontally polarized beam-steerable antenna for submillimeter-wave polarimetric imaging and collision avoidance radars," IEEE International Symposium on Antennas and Propagation (APSURSI), pp. 789-790, 2016.

F. Golcuk, T. Kanar and G. M. Rebeiz, "A 90-100-GHz 4x4 SiGe BiCMOS Polarimetric Transmit/Receive Phased Array With Simultaneous Receive-Beams Capabilities," IEEE Transactions on Microwave Theory and Techniques, vol. 61, pp. 3099-3114, 2013.

H. A. Wheeler, "Simple relations derived fom a phased-array antenna," IEEE Trans. on Antenn. and Propag., vol. 13, p. 506, 1965.

B. Munk, R. Taylor, T. Durham, W. Croswell, B. Pigon, R. Boozer, S. Brown, M. Jones, J. Pryor, S. Ortiz and others, "A low-profile broadband phased array antenna," IEEE Antennas and Propagation Society International Symposium, vol. 2, pp. 448-451, 2003.

(56) References Cited

OTHER PUBLICATIONS

A. Neto, D. Cavallo, G. Gerini and G. Toso, "Scanning performances of wideband connected arrays in the presence of a backing reflector," IEEE Transactions on Antennas and Propagation, vol. 57, pp. 3092-3102, 2009.
E. Magill and H. Wheeler, "Wide-angle impedance matching of a planar array antenna by a dielectric sheet," IEEE Transactions on Antennas and Propagation, vol. 14, pp. 49-53, 1966.
S. S. Holland and M. N. Vouvakis, "The planar ultrawideband modular antenna (PUMA) array," IEEE Transactions on Antennas and Propagation, vol. 60, pp. 130-140, 2012.
E. Yetisir, N. Ghalichechian and J. L. Volakis, "Ultrawideband Array With 70° Scanning Using FSS Superstrate," IEEE Transactions on Antennas and Propagation, vol. 64, pp. 4256-4265, 2016.
M. H. Novak and J. L. Volakis, "Ultrawideband antennas for multiband satellite communications at UHF-Ku frequencies," IEEE Transactions on Antennas and Propagation, vol. 63, pp. 1334-1341, 2015.
Y. H. Choung, "Wideband double-slot cross-notch antenna," IEEE Antennas and Propagation Society International Symposium, pp. 448-451, 2001.

* cited by examiner

MILLIMETER WAVE, WIDEBAND, WIDE SCAN PHASED ARRAY ARCHITECTURE FOR RADIATING CIRCULAR POLARIZATION AT HIGH POWER LEVELS

CROSS-REFERENCE TO RELATED APPLICATION(S)

The present application claims the benefit of U.S. Provisional Application Nos. 62/594,804 and 62/594,735, both filed Dec. 5, 2017, and the contents of each are hereby incorporated by reference.

STATEMENT OF GOVERNMENT INTEREST

The invention described herein may be manufactured, used, and licensed by or for the Government of the United States for all governmental purposes without the payment of any royalty.

BACKGROUND

There exists a need for electronically steerable antennas capable of operating at large bandwidths, operating frequencies, and polarization diversity, with high radiated power levels. An active electronically scanned array (AESA) is an antenna architecture that provides such performance. The AESA is a phased array that integrates a transmitter-receiver module (TR module) at every radiating element. One attractive feature of an AESA is modularity of the design, such that a radiating aperture can be designed independently of a transmit-receive (TR) module. While radiating apertures having high efficiency, decades of bandwidth, and dual polarizations have been previously developed, such these arrays typically operate below 20 GHz, where unit cells are on the order of centimeters in size. At these length scales, arbitrary geometries can be fabricated with high precision using low cost printed circuit board (PCB) processing techniques. However, there is a need for AESAs that operate at mm-wave frequencies. Increasing the operating frequency enables higher communication data rates attributable to the increased absolute bandwidth. In addition, mm-wave radars can provide higher resolution images due to the reduced wavelength. However, reducing the operating wavelength from the centimeter to the millimeter regime introduces significant design challenges. In particular, the wavelength is only ~10-100 times larger than the minimum feature size that can be fabricated using standard printed-circuit-board (PCB) or low temperature co-fired ceramic (LTCC) processing techniques, which limits the design freedom.

Operating at higher frequencies necessitates that the spacing between radiating elements should be scaled according to the wavelength. However, TR modules do not typically benefit from similar scaling laws, and TR modules providing roughly 1 W/element are typically several millimeters in size and independent of the frequency. At mm-wave frequencies, it is difficult to fit a 2D array of TR modules on a single printed-circuit-board (PCB). Another problem with such configurations is heat dissipation when operating at very high power levels.

Furthermore, it is desirable for the radiating aperture of a circularly polarized AESA to scan at wide angles of incidence from broadside. In this regard, linear-to-circular polarizers are used to convert an incident, linearly polarized plane wave into a transmitted, circularly polarized wave. Linear-to-circular polarizers are utilized from microwave to optical frequencies for a myriad of applications. Many of these applications also demand wide operating bandwidths and wide angles of incidence. However, conventional linear-to-circular polarizers only work perfectly at a single frequency making them inherently narrowband.

At THz frequencies and higher, wideband linear-to-circular polarizers are typically realized by cascading multiple birefringent waveplates with rotated principal axes. Polarizers utilizing cascaded waveplates can realize multiple octaves of bandwidth. At these higher frequencies, the geometry can afford to be many wavelengths in thickness while still maintaining a low profile since the wavelength is short. A disadvantage inherent in these designs is that they do not typically work well at wide angles of incidence since the optical thickness of the plate is a function of the angle of incidence.

At microwave frequencies, the most common linear-to-circular polarizers utilize cascaded patterned metallic sheets (i.e., sheet impedances) with subwavelength overall thicknesses. The bandwidth of microwave linear-to-circular polarizers are typically less than 40%. In some examples, the bandwidth has been increased up to an octave using meanderline metallic patterns printed on dielectric substrates. However, these meanderline polarizers do not typically work well at wide angles of incidence when their bandwidth is large.

Conventional waveplates composed of uniaxial dielectrics (i.e., $\varepsilon_{xx}=\varepsilon_{zz}\neq\varepsilon_{yy}$) only operate at a single frequency. It has been known since the 1950's that the bandwidth can be significantly extended by cascading waveplates with different thicknesses and relative orientations to develop so-called achromatic waveplates. These waveplates are commercially available at optical frequencies with bandwidths of over 4:1. While this design approach has been scaled down from optical frequencies to THz and mm-waves, as the wavelength is increased further, the required thickness of naturally occurring crystals becomes prohibitive due to the notable, weight, size, and loss.

In view of the above, it would be advantageous to provide an AESA capable of operating effectively at high frequencies and very high power levels for radiating circular polarization.

BRIEF DESCRIPTION OF THE DRAWINGS

The accompanying drawings provide visual representations which will be used to more fully describe various representative embodiments and can be used by those skilled in the art to better understand the representative embodiments disclosed and their inherent advantages. The drawings are not necessarily to scale, emphasis instead being placed upon illustrating the principles of the devices, systems, and methods described herein. In these drawings, like reference numerals may identify corresponding elements.

FIG. 4A is normal incidence, FIG. 4B is 45 degrees from normal, and FIG. 4C is 60 degrees from normal;

FIG. 10A is normal incidence, FIG. 10B is 45 degrees from normal, and FIG. 10C is 60 degrees from normal;

SUMMARY

Figure 1A:
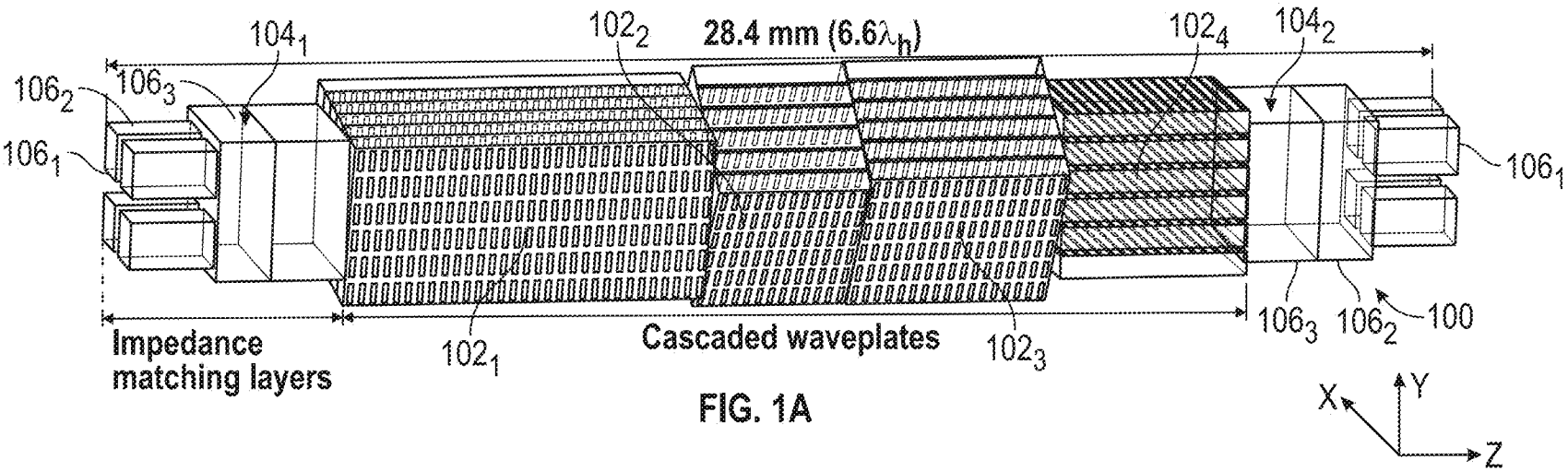
FIGS. 1A and 1B are high-level schematic diagrams of an ultra-wideband linear-to-circular polarizer in accordance with an embodiment of the present invention.

There is provided an active electronically scanned array (AESA), which includes a linear-to-circular polarizer coupled to a radiating aperture. The AESA further includes one or more transmit-receive modules coupled to radiating elements and a plurality of distributed liquid cooling ducts disposed adjacent the one or more transmit-receive modules to provide cooling of the AESA during high-power operation.

In accordance with another embodiment, the AESA includes one or more cooling manifolds, where each cooling manifold has a plurality of distributed liquid cooling ducts.

In accordance with a further embodiment, the one or more cooling manifolds are bonded to one or more of the transmit-receive modules.

In accordance with yet another embodiment, the linear-to-circular polarizer, transmit-receive modules and one or more cooling manifolds are configured in a stacked arrangement.

In accordance with a further embodiment, the transmit-receive modules are connected in a flip-chip assembly.

In accordance with still another embodiment, a heat exchanger is fluidly coupled to the one or more cooling manifolds.

In accordance with yet another embodiment, there is provided a plurality of linearly polarized radiating elements, where each radiating element is coupled to a printed circuit board (PCB) column.

In accordance with still another embodiment, a plurality of layers of PCBs are coupled to the radiating aperture.

In accordance with yet another embodiment, the cooling ducts are disposed between the PCBs.

In accordance with a further embodiment, the linear-to-circular polarizer consists of a plurality of cascaded waveplates having biaxial permittivity. Each waveplate has a principal axis rotated at different angles relative to an adjacent waveplate about a z-axis of a 3-dimensional x, y, z coordinate system, and impedance matching layers are disposed adjacent the cascaded waveplates.

In accordance with another embodiment, the linear to circular polarizer consists of a plurality of cascaded anisotropic sheets. Each sheet has a principal axis rotated at different angles relative to an adjacent sheet about a z-axis of a 3-dimensional x, y, z coordinate system and impedance matching layers are disposed adjacent the cascaded sheets.

DETAILED DESCRIPTION

Specific embodiments of the invention will now be described in detail with reference to the accompanying figures. While this invention is susceptible of being embodied in many different forms, there is shown in the drawings and will herein be described in detail specific embodiments, with the understanding that the present invention is to be considered as an example of the principles of the invention and not intended to limit the invention to the specific embodiments shown and described. In the description below, like reference numerals may be used to describe the same, similar or corresponding parts in the several views of the drawings.

All documents mentioned herein are hereby incorporated by reference in their entirety. References to items in the singular should be understood to include items in the plural, and vice versa, unless explicitly stated otherwise or clear from the text.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

In particular, for an arbitrary structure illuminated with a normally incident plane wave, the linearly polarized transmission matrix ($T^{LIN}$) of the structure relates the incident electric field $E_i$ to the transmitted electric field $E_t$:

$$\begin{pmatrix} E_t^x \\ E_t^y \end{pmatrix} = T^{LIN}\begin{pmatrix} E_i^x \\ E_i^y \end{pmatrix} = e^{-j\delta}\begin{pmatrix} T_{xx} & T_{xy} \\ T_{yx} & T_{yy} \end{pmatrix}\begin{pmatrix} E_i^x \\ E_i^y \end{pmatrix},$$

where δ represents a constant phase shift. An ideal linear-to-circular polarizer converts an incident x-polarization to a transmitted right-hand circular polarization. This may be represented by $T_{xx}=1/\sqrt{2}$ and $T_{yx}=-j/\sqrt{2}$. It is convenient to characterize the performance of a linear-to-circular polarizer by considering the linear-to-circular transmission matrix ($T^{CP}$), which may be defined as:

$$\begin{pmatrix} E_t^R \\ E_t^L \end{pmatrix} = T^{CP}\begin{pmatrix} E_i^x \\ E_i^y \end{pmatrix} = \begin{pmatrix} T_{Rx} & T_{Ry} \\ T_{Lx} & T_{Ly} \end{pmatrix}\begin{pmatrix} E_i^x \\ E_i^y \end{pmatrix},$$

where R and L denote transmission into right- and left-handed circular polarizations, respectively. Ideally, $T_{Rx}=1$ and $T_{Lx}=0$. The polarization purity of the transmitted wave is often expressed in terms of the axial ratio (AR), which can be related to the linear-to-circular transmission matrix by:

$$AR = \frac{|T_{Rx}/T_{Lx}|+1}{|T_{Rx}/T_{Lx}|-1}.$$

A y-polarized wave is not considered in this description.

The polarizers described herein are reported at different angles of incidence, where the E and H planes are defined relative to the plane of the incident wave. In this regard, the E-plane corresponds to the $\phi=0°$ plane and the H-plane is the $\phi=90°$ plane. It should also be noted that the term $T_{Rx}$ characterizes the transmission of both obliquely incident waves and normally incident waves.

Figure 1B:
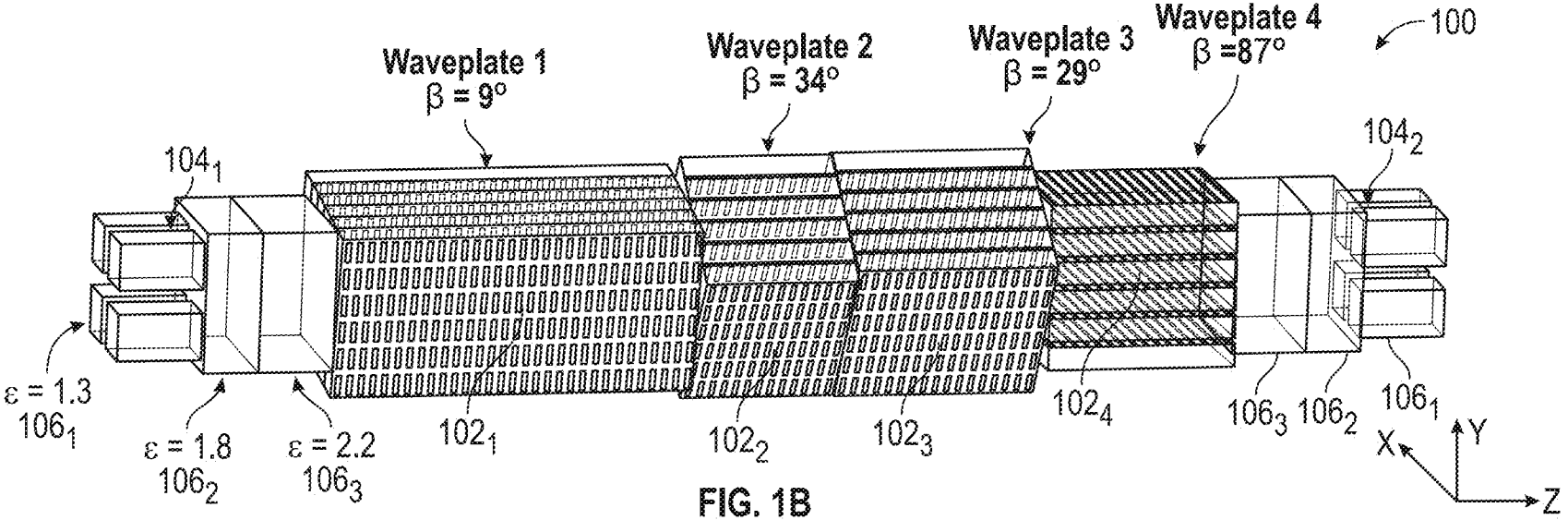

FIGS. 1A and 1B are high-level schematic diagrams of a linear-to-circular polarizer 100 in accordance with an embodiment of the present invention. The linear-to-circular polarizer 100 includes a plurality of cascaded waveplates $\mathbf{102}_1 \ldots \mathbf{102}_N$ (where "N" is any suitable number) (depicted with four waveplates in the example embodiment) disposed relative to a 3-dimensional x, y and z coordinate system. The cascaded waveplates $\mathbf{102}_1 \ldots \mathbf{102}_N$ exhibit biaxial permittivity. Each waveplate has a principal axis rotated at different angles relative to an adjacent waveplate about the z-axis, and each waveplate can be provided with a respective length with respect to the z-axis different from a length of an adjacent waveplate. The polarizer 100 further includes impedance matching layers $\mathbf{104}_1$, $\mathbf{104}_2$ that are disposed adjacent, or substantially adjacent, the cascaded waveplates $\mathbf{102}_1 \ldots \mathbf{102}_N$. In the example shown, the overall length of the assembly is approximately 28.4 mm corresponding to wavelengths of approximately $6.6\lambda_h$. This is merely illustrative, as the configuration is dependent upon the desired operating conditions as explained further below.

For a single waveplate polarizer, ignoring reflection losses and absorption, the transmission matrix of the waveplate may be represented by:

$$T_{wp}(\beta, d\Delta n) = R(\beta)^{-1}\begin{pmatrix} 1 & 0 \\ 0 & e^{-jk_0 d\Delta n} \end{pmatrix}R(\beta)$$

Figure 2:
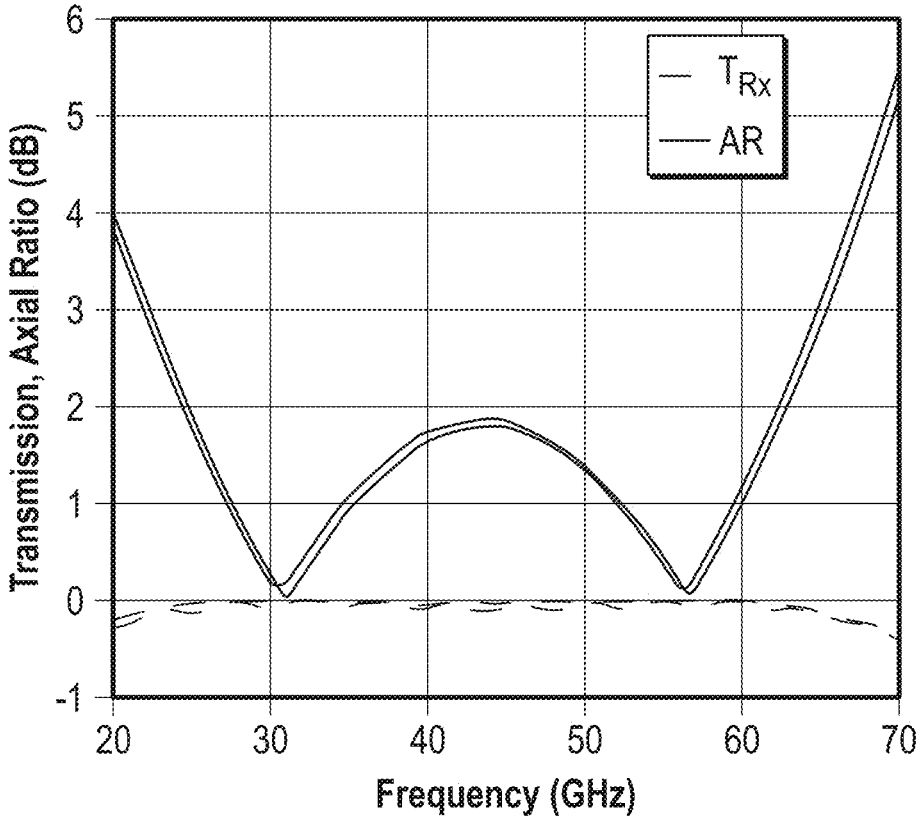
FIG. 2 is a graphical representation of the simulated response when the permittivities of a pair of waveplates are increased and the polarizer is illuminated at an angle of incidence of 45° in the E- and H-planes.

Because performance is sensitive to the angle of incidence, in accordance with the present invention the permittivity is increased to bend the wave towards the normal direction as it propagates through the structure in accordance with Snell's law. The angle of incidence is further increased by controlling the permittivity of the waveplates $\mathbf{102}_1 \ldots \mathbf{102}_N$ in the x, y and z directions to reduce the index contrast between the two eigenpolarizations at oblique angles, which compensates for the increased optical thickness attributable to the impedance matching layers $\mathbf{104}_1$, $\mathbf{104}_2$. For example, if the permittivity in the z-direction is increased such that $$\varepsilon_1 = \begin{pmatrix} 1.02 & 0.05 & 0 \\ 0.05 & 1.16 & 0 \\ 0 & 0 & 1.08 \end{pmatrix}, \varepsilon_2 = \begin{pmatrix} 1.08 & 0.02 & 0 \\ 0.02 & 1.01 & 0 \\ 0 & 0 & 1.04 \end{pmatrix},$$

the transmission coefficient and axial ratio at 45° scan in the E and H planes as shown in graphical representation of FIG. 2. The response at oblique angles is analogous to a broadside case when the z-directed permittivity is properly chosen. The z-directed permittivity may be near the geometric mean of the u and v directed permittivities (i.e., the transverse permittivities along the principal axes) for the polarizer to be operable at wide scan angles.

Referring further to FIGS. 1A and 1B, each dielectric matching assembly of impedance matching layers $\mathbf{104}_1$, $\mathbf{104}_2$ impedance matches the artificial dielectrics to free space. Each dielectric assembly $\mathbf{104}_1$, $\mathbf{104}_2$ includes a first section $\mathbf{106}_1$ having a first permittivity $\epsilon_1$, a second section $\mathbf{106}_2$ having a second permittivity $\epsilon_2$ greater than the first permittivity, and a third section $\mathbf{106}_3$ having a third permittivity $\epsilon_3$ greater than the second permittivity. These sections may be referred to as "matching layers." The thickness and orientation of the different sections can be optimized using a genetic algorithm as will be appreciated by those skilled in the art. An example expedient was implemented in MATLAB®, where for simplicity, the anisotropic dielectric slabs all have the same permittivity. In total there are 14 degrees of freedom that need to be optimized: thickness and permittivity of the 3 matching layers (6 unknowns), and thickness and orientation of the 4 anisotropic dielectrics (8 unknowns).

As an example, an algorithm optimization begins with an initial population of 200 randomly seeded individuals. The transmission coefficients, $T_{Rx}(\omega,\theta,\phi)$ and $T_{Lx}(\omega,\theta,\phi)$ of each individual are analytically calculated for normal and oblique angles of incidence The individuals with lowest cost are selected from the population, randomly mutated, and the process is repeated. The cost function that is minimized is given by, $$= \sum_{\omega}\left[(1+|T_{Lx}(\omega, 0°, 0°)|-|T_{Rx}(\omega, 0°, 0°)|)^5 + \sum_{\phi}\left(\frac{(1+|T_{Lx}(\omega, 60°, \phi)|-|T_{Rx}(\omega, 60°, \phi)|)^5}{10}\right)\right]$$

where $T_{Rx}(\omega,\theta,\phi)$ and $T_{Lx}(\omega,\theta,\phi)$ are the transmission coefficients when excited with a plane wave at a given frequency and angle of incidence.

This cost function maximizes $T_{Rx}$ and minimizes $T_{Lx}$ which minimizes insertion loss and axial ratio over the desired bandwidth and angles of incidence. The transmission coefficients are calculated at 21 frequency points between approximately 15 GHz and 70 GHz, and at angles of incidence $\phi$=0°, 60° and $\phi$=−45°, 0°, 45°, 60°. A larger weight is assigned to the transmission coefficients at normal incidence. The summed elements within the cost function $(1+|T_{Lx}|-|T_{Rx}|)$ are raised to the 5th power, which helps optimize for the worst-case scenario. It should be emphasized that the cost function can be evaluated analytically (i.e. full wave simulations are not required), which leads to relatively quick convergence. The optimization process takes on the order of 30 minutes to complete with a 24 core CPU running at 2.5 GHz.

Once the optimal material permittivities and thicknesses are determined, each layer is physically implemented. The impedance matching layers are physically realized by stacking together different substrates. With reference again to FIG. 1, the effective permittivities of the impedance matching layers are approximately 1.3, 1.8, and 2.2, with thicknesses equal to approximately 1.8 mm, 1.2 mm, and 1.6 mm, respectively. A broadband impedance match between free space and the cascaded waveplates is realized by gradually transitioning the permittivity. The permittivity of the outermost dielectric is reduced from approximately 1.8 to 1.3, by milling trenches in the substrate.

Figure 3:
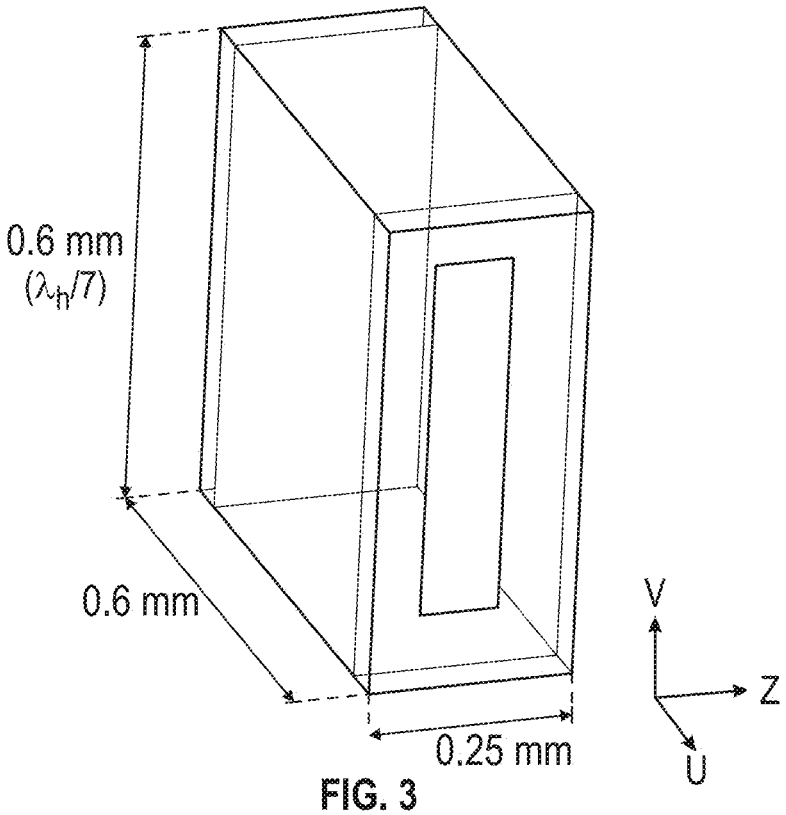
FIG. 3 is an isometric schematic of a unit cell of the cascaded, anisotropic waveplates in accordance with an embodiment of the invention.

A unit cell of the cascaded, anisotropic waveplates is shown in FIG. 3. It is designed using standard dielectric mixing formulas to realize the optimized anisotropic permittivity. The principal axes of the unit cell are oriented along the u, v, and z directions. Each cell consists of approximately 0.5 mm thickness Rogers 4003 substrate ($\varepsilon$=3.55) patterned with a copper patch that is approximately 0.1 mm×0.45 mm in size. The copper rectangle primarily increases the permittivity in the v direction, while minimally affecting the permittivity in the u and z directions. The small unit cell size reduces the effects of both temporal and spatial dispersion. The effective permittivity tensor of the unit cell was extracted by illuminating a 10-unit cell thick slab with normally incident plane waves propagating in the z and u directions, $$\begin{pmatrix} \varepsilon_{uu} & \varepsilon_{uv} & \varepsilon_{uz} \\ \varepsilon_{vu} & \varepsilon_{vv} & \varepsilon_{vz} \\ \varepsilon_{zu} & \varepsilon_{zv} & \varepsilon_{zz} \end{pmatrix} = \begin{pmatrix} 2.45 & 0 & 0 \\ 0 & 4.1 & 0 \\ 0 & 0 & 3.2 \end{pmatrix}$$

The orientation of the different layers are $\beta$=9°, $\beta$=34°, $\beta$=29°, and $\beta$=87°, for the first through fourth layers, respectively. The thickness (length) of the respective layers is approximately $t_1$=7.75 mm, $t_2$=3.25 mm, $t_3$=4.25 mm, and $t_4$=4.00 mm.

It will be understood by those skilled in the art that by increasing the anisotropy of the waveplate, the thickness can be reduced. In addition, this increases robustness to fabrication tolerances since the performance of a waveplate is proportional to the difference in the indices of refraction along the principal directions (i.e., $\sqrt{\varepsilon_{vv}}-\sqrt{\varepsilon_{uu}}$). For example, a single waveplate illuminated at normal incidence with $\varepsilon_{uu}$=3.2 and $\varepsilon_{vv}$=3.5 converts an incident linear polarization to circular polarization. If the permittivity of $\varepsilon_{vv}$=3.5 that converts an incident linear polarization to circular polarization. If the permittivity of $\varepsilon_{vv}$=3.5 is reduced by approximately 5% due to manufacturing tolerances, the axial ratio of the transmitted field will increase from approximately 0 dB to 7.5 dB. However, if the designed permittivity contrast is increased such that $\varepsilon_{uu}$=2 and $\varepsilon_{vv}$=3.5, then a 5% decrease in $\varepsilon_{vv}$ only increases the axial ratio to 1 dB. At the same time, the permittivity contrast should not be increased more than approximately 15% since this makes it more difficult to impedance match the waveplates to free space using isotropic dielectrics.

The cascaded waveplates typically cannot be simulated as a single unit cell in a periodic lattice since the principal axes of the anisotropic layers are all different. Therefore, the simulated S-parameters of the polarizer are typically calculated by cascading the S-parameters of the individual waveplates. This technique assumes the field at the boundary between two different waveplates is accurately represented by the fundamental Floquet modes, which are propagating plane waves with TE and TM polarizations. In other words, the simulation neglects evanescent coupling between the different waveplates, which is expected to contribute only minor influences on the polarizer's response. Note that the circuit solver in the HFSS® modeling tool provides a convenient method of cascading the S-parameters of the individual waveplates.

Figure 4A:
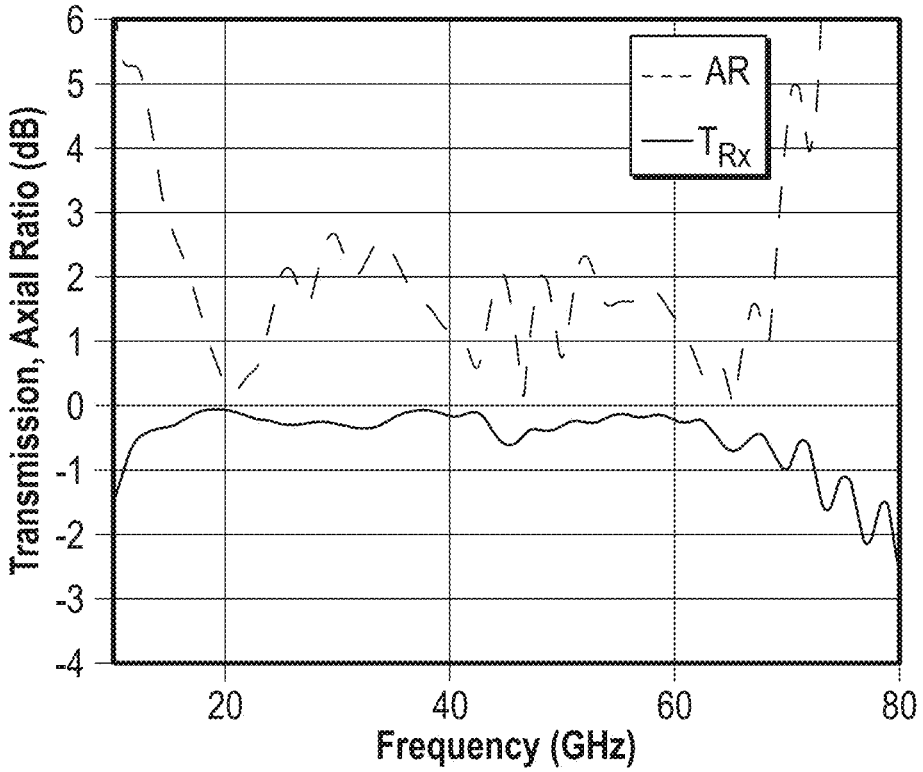
FIGS. 4A, 4B and 4C, are depictions of the simulated transmission coefficient and axial ratio for a polarizer in accordance with an embodiment of the invention when illuminated with an x-polarized plane wave for different angles of incidence, where
Figure 4B:
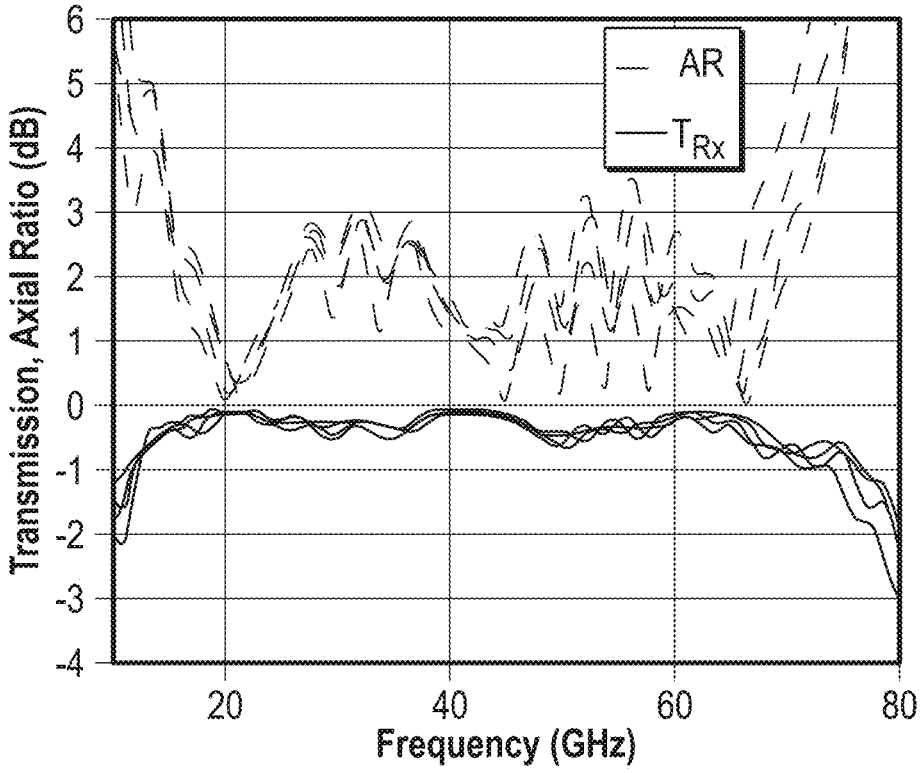
Figure 4C:
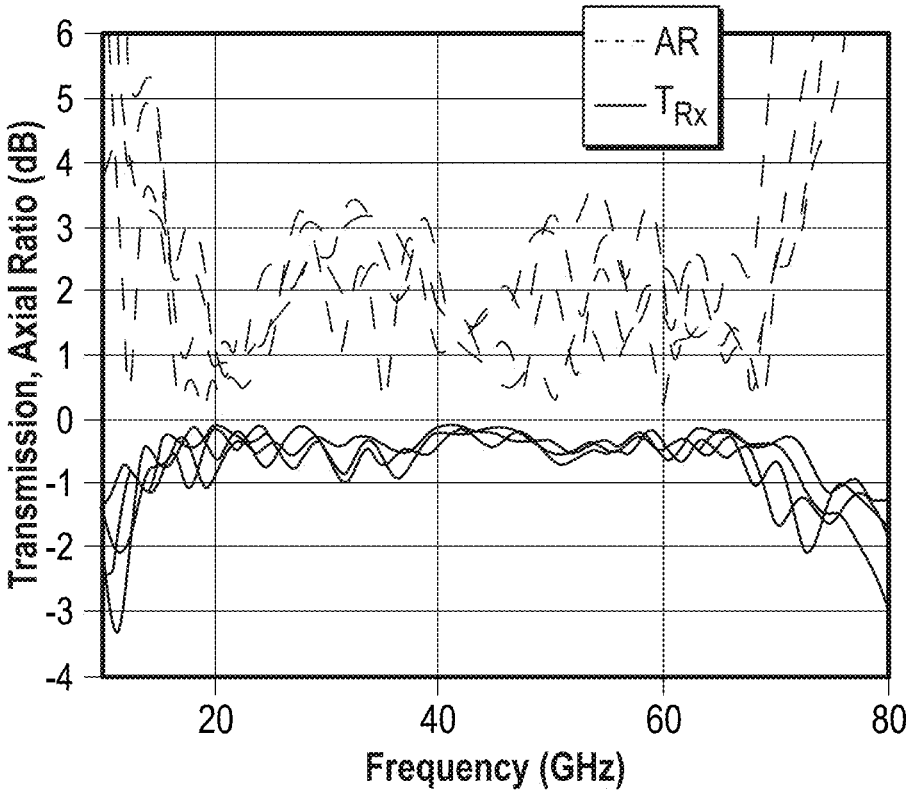

Referring now to FIGS. 4A, 4B and 4C, there is depicted the simulated transmission coefficient and axial ratio when illuminated with an x-polarized plane wave for different angles of incidence. At normal incidence, the transmission coefficient ($T_{Rx}$) is above −1 dB between approximately 11 GHz and 72 GHz, and the axial ratio (AR) is below 3 dB from approximately 15 GHz to 70 GHz (4.7:1 bandwidth). This polarizer also performs well at oblique incidence as shown in FIGS. 4B and 4C.

In accordance with an embodiment of the present invention, an ultra-wideband linear-to-circular polarizer 100 is realized by modifying the conventional geometry of a meanderline polarizer. As described above, by rotating the principal axes of the various layers it is possible to increase the operable degrees-of-freedom, which can be leveraged to enhance bandwidth. Therefore, the orientation of each sheet is a free variable that is optimized. Furthermore, each sheet is not restricted to only meanderline geometries, which provides additional degrees of freedom. In other words, the layers are best represented as general, anisotropic sheet impedances.

A section of an example cascaded sheet impedance polarizer is depicted in FIGS. 5A, 5B, 5C and 5D. Algorithm optimization may be utilized to design the polarizer. The polarizer includes impedance matching layers $\mathbf{104}_1$, $\mathbf{104}_2$ on the outside, and cascaded anisotropic metallic patterns printed on Rogers 4003 substrates (waveplates $\mathbf{102}_1$, $\mathbf{102}_2$, . . . $\mathbf{102}_8$) disposed between impedance matching layers $\mathbf{104}_1$, $\mathbf{104}_2$ and rotated relative to the z-axis as described above. In an example, the permittivity of the 4003 substrate (ε=3.55) is large enough to improve the performance at wide scan angles, but not too large to enable a broadband impedance-match to free space. In total, 8 patterned copper sheets are used, which are spaced approximately 0.4 mm apart in the z-direction. This results in roughly 25 unknowns that need to be optimized: thickness and permittivity of the 3 matching layers (6 unknowns), and dimensions (roughly 11 unknowns) and orientation (8 unknowns) of the patterned metallic sheets. Again, the cost function described above is utilized to minimize insertion loss and axial ratio over the operational bandwidth at normal and oblique angles of incidence.

Figure 5A:
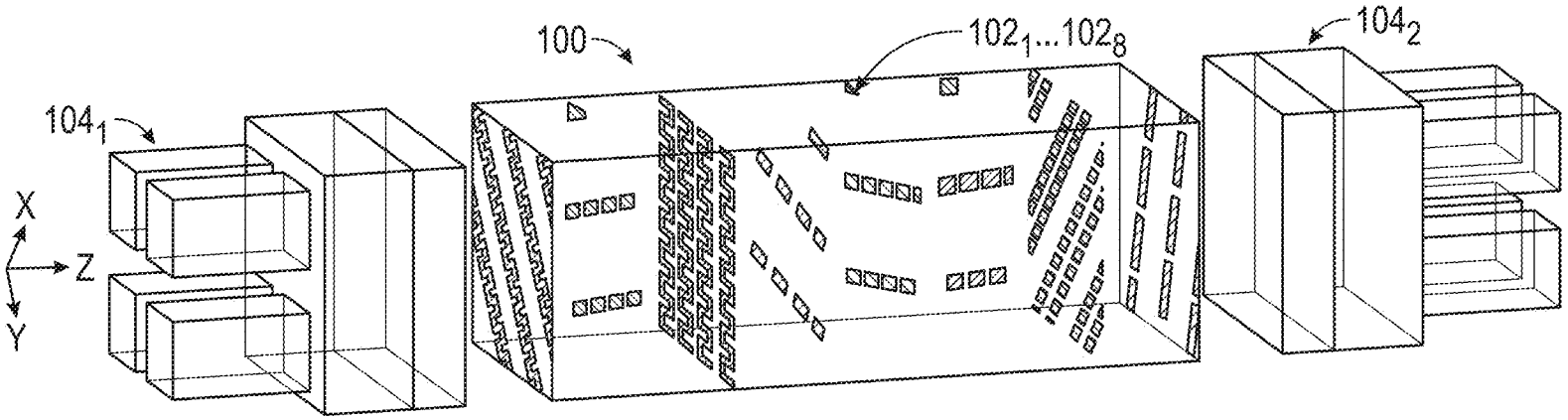
FIGS. 5A, 5B, 5C and 5D are illustrations of a section of an example cascaded sheet impedance polarizer in accordance with an embodiment of the present invention.
Figure 5B:
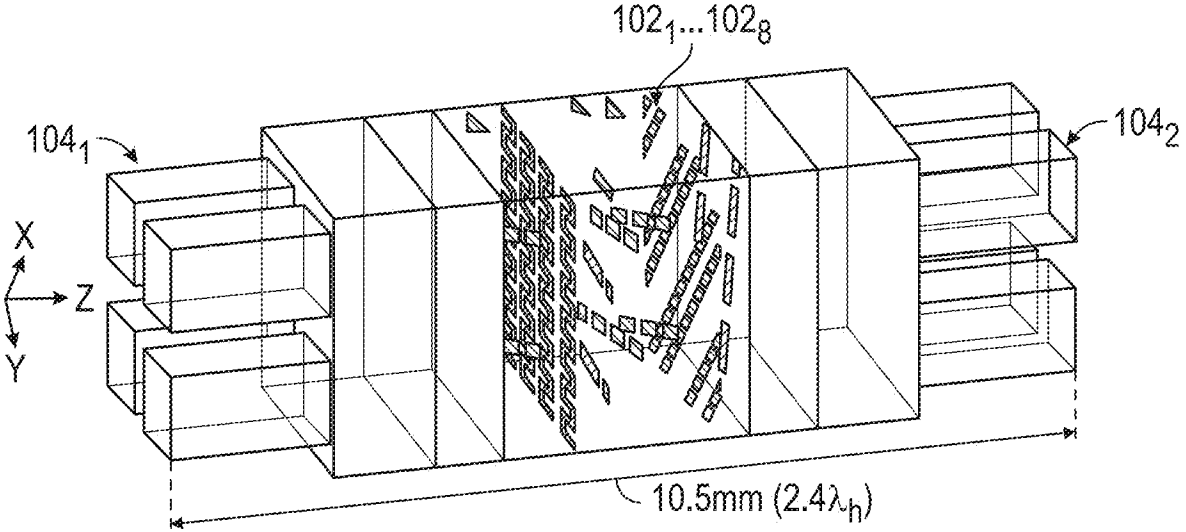
Figure 5C:
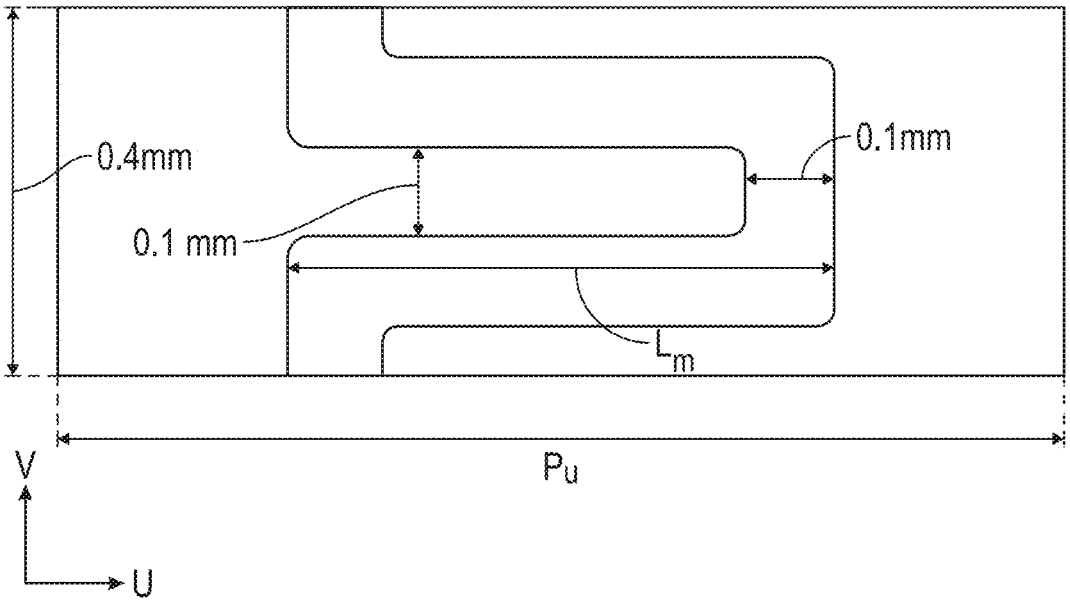
Figure 5D:
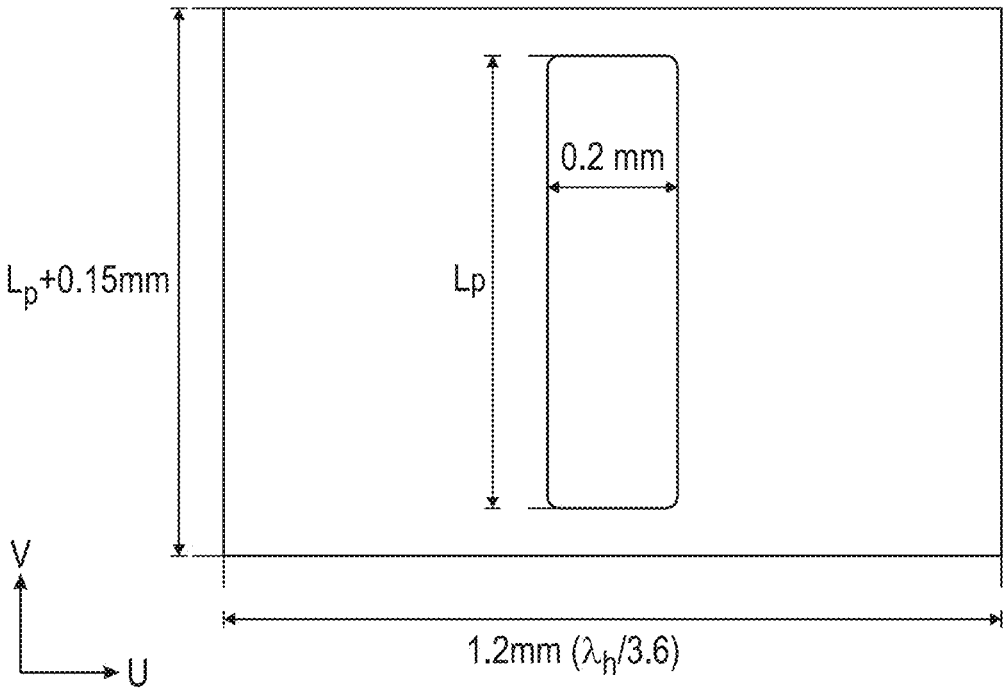

Two different metallic geometries are considered for each sheet: meanderline and metallic patches, as shown FIGS. 5C and 5D. In this implementation, parametric sweeps were performed using ANSYS HFSS® to extract the anisotropic sheet impedances of the patterned metallic geometries as a function of their dimensions ($L_m$, $P_u$, and $L_p$) and frequency, at normal incidence. Simulations demonstrated that the sheet impedance is not a strong function of the angle of incidence. Interpolation may be utilized to approximate the sheet impedance of geometries that are not explicitly simulated. The dimension $L_m$ primarily controls the inductance of the meanderline in the v-direction, while $P_u$ determines the capacitance in the u-direction. The dimension $L_p$ primarily affects the capacitance of the patch along the v-direction. Again, the u and v directions correspond to the principal axes of each sheet, which are rotated by an angle relative to the global xy coordinate system. The simulated sheet impedances are inserted into a MATLAB® routine that analytically calculates the S-parameters of the cascaded structure and the dimensions and orientation of each sheet may optimized.

A brute force sweep may be used to determine which sheets utilize meanderline geometries and which sheets utilize patches. First, every sheet is forced to be of the metallic patch geometry, and the genetic algorithm finds the minimum cost for this case by optimizing $L_p$, and β of each sheet, as well as the permittivity and thickness of the impedance matching layers. Then, the first sheet is replaced with the meanderline geometry and again the minimum cost is calculated using the genetic algorithm. This process is repeated until every possible combination of meanderline and patch geometry is considered, of which there are a total of $2^8$=256 combinations. At the end, the meanderline/patch combination with the lowest calculated cost is chosen. The optimal combination utilizes meanderline geometries on the first, third, and seventh sheets. However, other options may be utilized to provide similar performance, with this implementation being merely an example.

The optimized dimensions of each patterned metallic sheet are shown in the following table:

| Sheet# | $L_m$ (mm) | $P_u$ (mm) | $L_p$ (mm) | β (deg.) |
|---|---|---|---|---|
| 1 | 0.28 | 0.98 | NA | 5 |
| 2 | NA | NA | 0.63 | 118 |
| 3 | 0.60 | 0.84 | NA | 46 |
| 4 | NA | NA | 0.70 | 143 |
| 5 | NA | NA | 0.55 | 126 |
| 6 | NA | NA | 0.78 | 119 |
| 7 | 0.60 | 1.10 | NA | 89 |
| 8 | NA | NA | 0.76 | 60 |

The effective permittivities of the impedance matching layers shown in FIG. 5A are approximately 1.3, 1.8, and 3.0, with thicknesses equal to approximately 1.8 mm, 1.2 mm, and 0.75 mm, respectively.

Figure 6A:
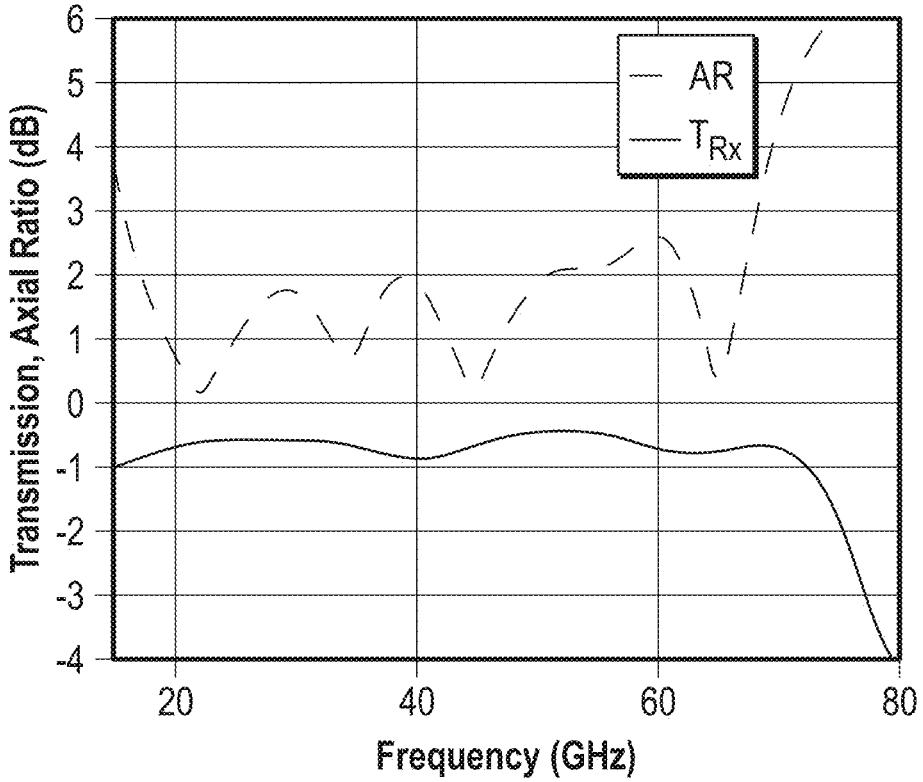
FIGS. 6A, 6B and 6C are graphical representations of simulated performance of the polarizer shown in FIGS. 5A, 5B, 5C and 5D.
Figure 6B:
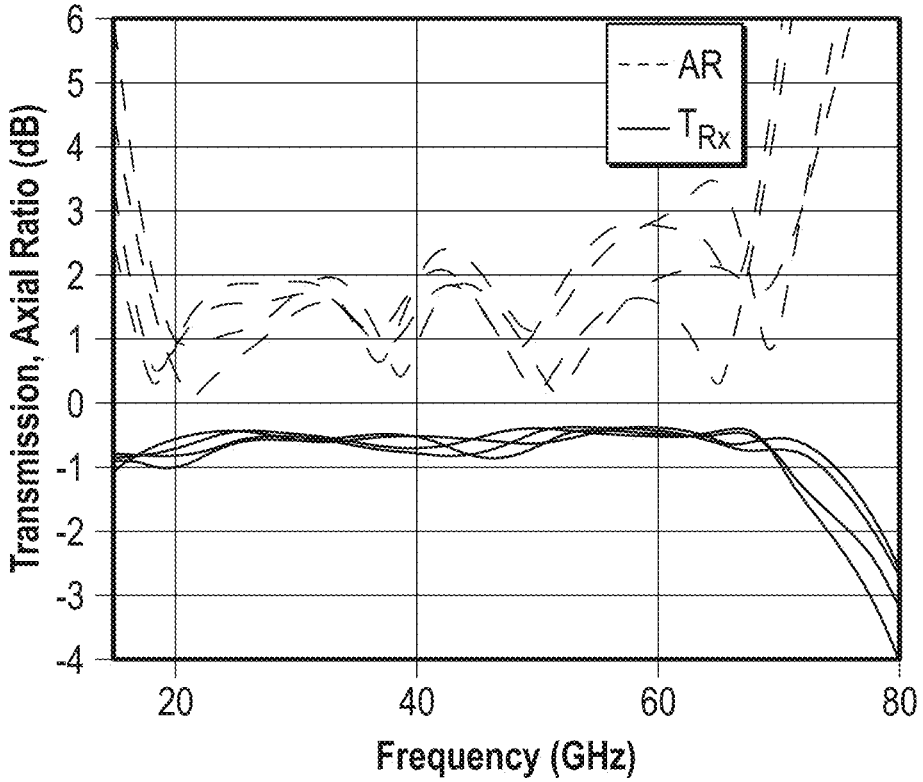
Figure 6C:
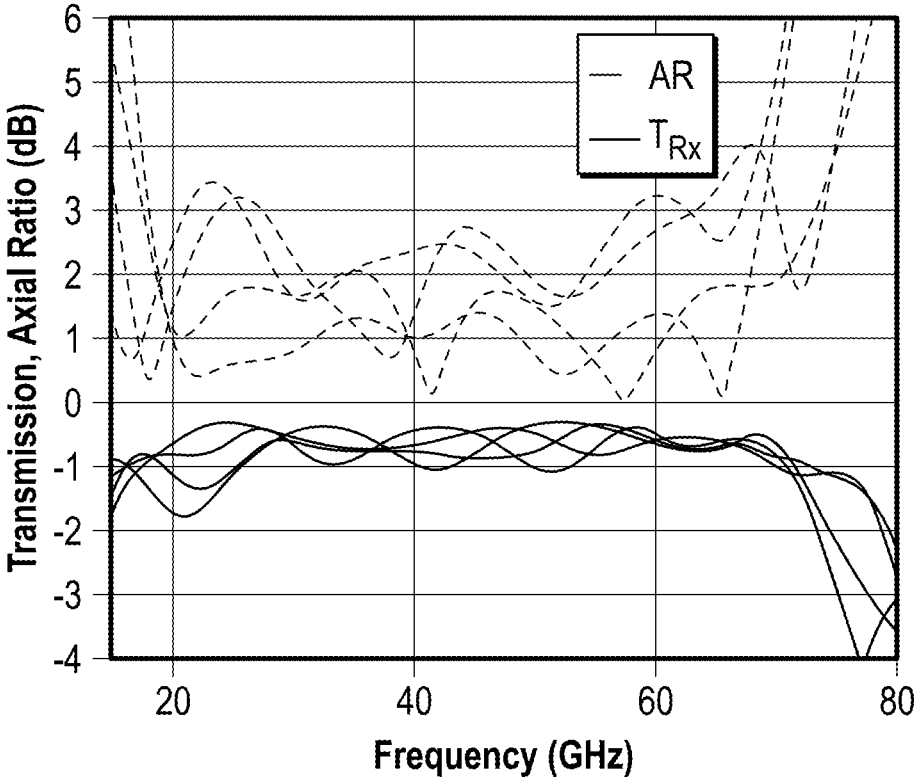

Since it may be inefficient to rigorously simulate the entire polarizer using a full-wave solver. the S-parameters of the different layers are cascaded together using the circuit solver in the ANSYS HFSS® modeling tool to calculate the S-parameters of the overall structure. Full wave simulations of similar geometries that are periodic verified that simply cascading S-parameters provides an accurate estimate of the overall performance. In other words, evanescent coupling between the different layers can be neglected for these cells sizes and interlayer spacing. The simulated performance is shown graphically in FIGS. 6A, 6B and 6C.

At normal incidence, the transmission coefficient ($T_{Rx}$) is above approximately −1 dB between approximately 15 GHz and 72 GHz, and the axial ratio is below approximately 3 dB from approximately 16 GHz to 68 GHz (4.2:1 bandwidth). When illuminated at 60° from normal incidence in the E, H, and diagonal planes, the peak axial ratio increases to approximately 4 dB within the operating band. In this regard, the polarizer performs well at oblique angles of incidence.

Linear-to-circular polarizers in accordance with embodiments of the present invention may be fabricated and measured using a Gaussian beam telescope. In an example embodiment, this system generates an incident Gaussian beam with beam waist diameter roughly equal to 3λ, which significantly reduces the required fabricated area compared to the case where a single lens or no lenses are used. The system operates between approximately 15 GHz and 110 GHz. The Gaussian beam telescope consists of 2 linearly polarized standard gain horn antennas on either side of the polarizer under test. The horns have a high gain (~23 dB), and their radiated beams are quasi-Gaussian (85% coupling to the fundamental Gaussian mode). In order to characterize the polarizers across the wide operating bandwidth, four different standard gain horn antennas were used to cover the K, Ka, V, and W bands. The horns are connected to a 2-port network analyzer that is integrated with frequency extenders to allow for measurements of the S-parameters up to 110 GHz. The system utilizes 4 plano-convex Teflon® lenses with approximately 100 mm diameters and approximately 150 mm focal lengths. The lenses are separated from each other by the sum of their focal lengths (300 mm), which generates a collimated quasi-Gaussian beam at the center of the system with unity magnification at all operating frequencies. The polarizers are mounted on a 3D printed rotation stage that allows for measuring the transmission coefficients at normal incidence and oblique incidence, along different planes (e.g., E, H, and diagonal planes). The beam waist diameter at the lower operating frequencies (approximately 15 GHz) is calculated to be ~50 mm, and it reduces as the frequency increases. Therefore, the cross-sectional diameter of the polarizer in this example needs to be approximately at least 50 mm. Orienting the polarizer for measurements at oblique angles reduces the effective cross-sectional area seen by the incident Gaussian beam. For example, a 60° scan angle effectively reduces the polarizer's area by approximately one-half.

Linearly polarized horn antennas may be used to measure the polarizers. However, when characterizing the linear-to-circular transmission matrix it is helpful to have knowledge of the transmitted field along two independent polarizations. Conceptually, the simplest method of characterizing the transmitted field is to first orient the receive horn to receive x-polarization, and then rotate the horn by 90° to receive y-polarization. Once $T_{xx}$ and $T_{yx}$ are known, it is straightforward to calculate $T_{Rx}$, $T_{Lx}$, or equivalently, the transmitted axial ratio. This approach may be less than desirable since the phase center of the receive horn can easily shift when physically rotated. Thus, it is advantageous to first orient the two horns to measure $T_{xx}$. To measure an additional component of the transmitted polarization, a wire-grid polarizer oriented along the x+y direction is inserted into the path of the Gaussian beam, after the polarizer under test. The transmission coefficients of the wire-grid polarizer along its two principal axes are independently measured so that its presence can be properly calibrated. By utilizing measurements with and without the wire-grid polarizer in the beam's path, it is possible to extract the transmitted field along two independent polarizations. These measurements are used to characterize $T_{Rx}$ and the transmitted axial ratio.

Figure 7A:
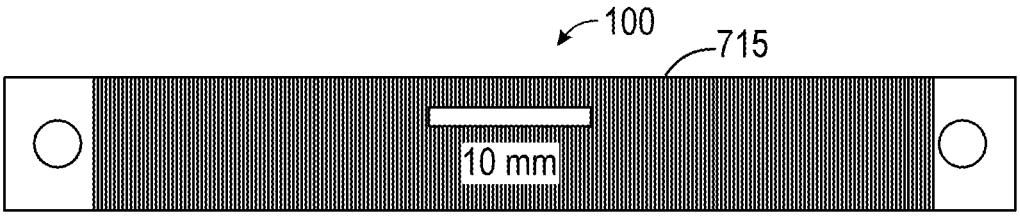
FIGS. 7A, 7B and 7C are illustrations of a cascaded waveplate polarizer fabricated by stacking together chemically etched printed-circuit-boards in accordance with an embodiment of the invention.
Figure 7B:
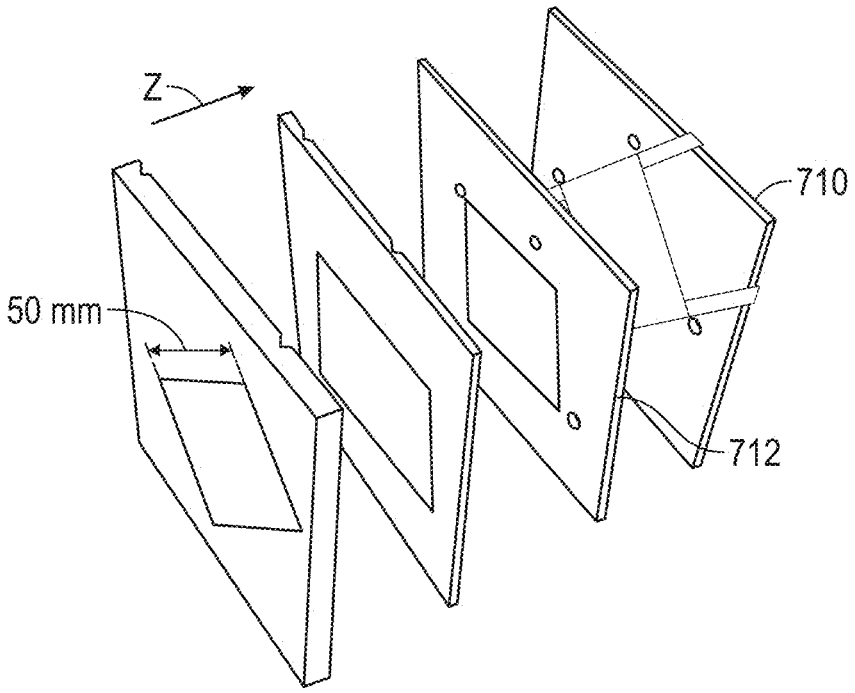
Figure 7C:
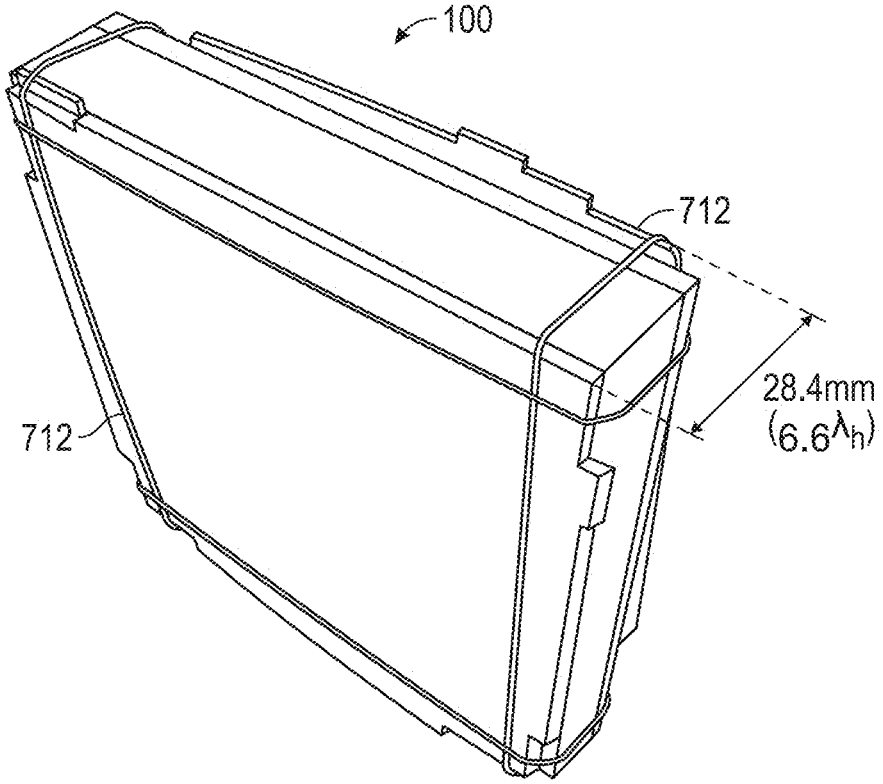

With reference to FIGS. 7A, 7B and 7C, a cascaded waveplate polarizer 100 in accordance with an embodiment of the present invention may be fabricated by stacking together chemically etched printed-circuit-boards (PCBs) 710. One of the fabricated PCBs 710 for the first waveplate $\mathbf{102}_1$ is depicted in FIG. 7A. This PCB is stacked together with 83 identical PCB's in the u-direction (see the unit cell illustrated in FIG. 3) to construct waveplate $\mathbf{102}_1$. A designed approximately 0.1 mm air gap between the stacked PCBs (in the u-direction) is realized by placing approximately 0.1 mm shims between the boards at the edges thereof. The same process is employed to construct the other waveplates $\mathbf{102}_2$, $\mathbf{102}_3$, $\mathbf{102}_4$. The 4 different cascaded waveplates are depicted in FIG. 7B. In the figure, the components are spaced apart for clarity. As shown in FIG. 7C, 3D printed holders 712 support each PCB in the proper orientation.

Figure 8:
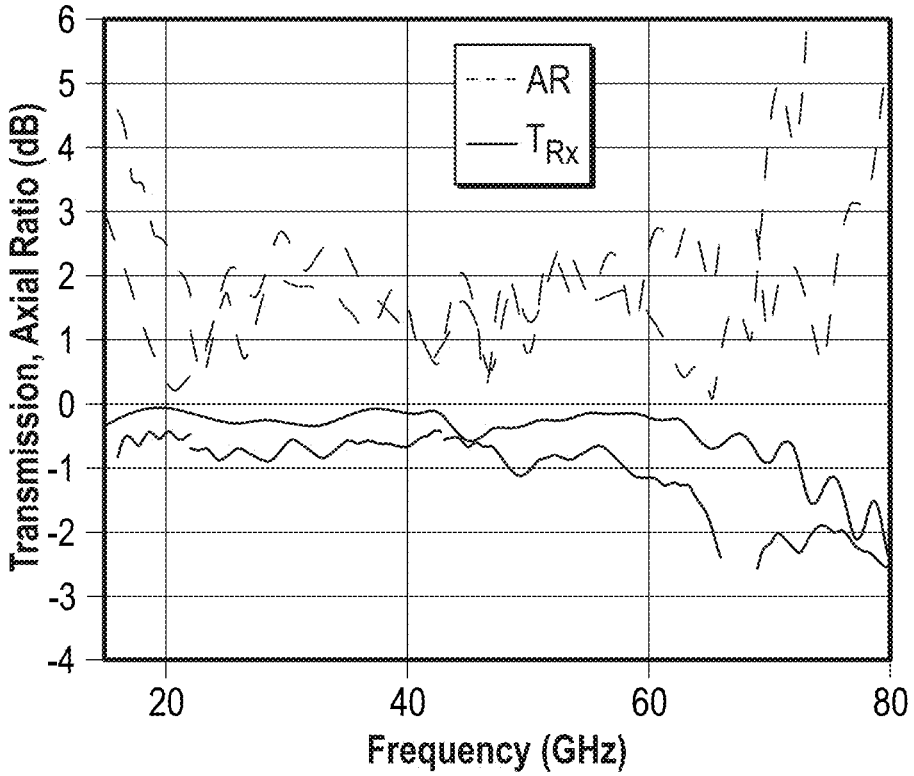
FIG. 8 is a graphical representation of the cascaded waveplate polarizer's measured and simulated transmission coefficient ($T_{Rx}$), and axial ratio (AR) at normal incidence.

With reference to FIG. 8, there is shown a graphical representation of the cascaded waveplate polarizer's measured and simulated transmission coefficient ($T_{Rx}$), and axial ratio (AR) at normal incidence. There is good agreement between measurement and simulation. The gap in measured frequencies at 67 GHz corresponds to the location where the network analyzer switches modes between using internal signal generators (below 67 GHz) and external frequency extenders (above 67 GHz). The measured axial ratio is below approximately 3 dB between approximately 19 GHz and 76 GHz (4:1 bandwidth), and the insertion loss is below 2.5 dB over this frequency range. The insertion loss of the measurements is about 0.5 dB larger than simulations, which could be due to fabrication tolerances, metal surface roughness, and/or air gaps between the 4 different waveplate sections and impedance matching layers.

Figure 9A:
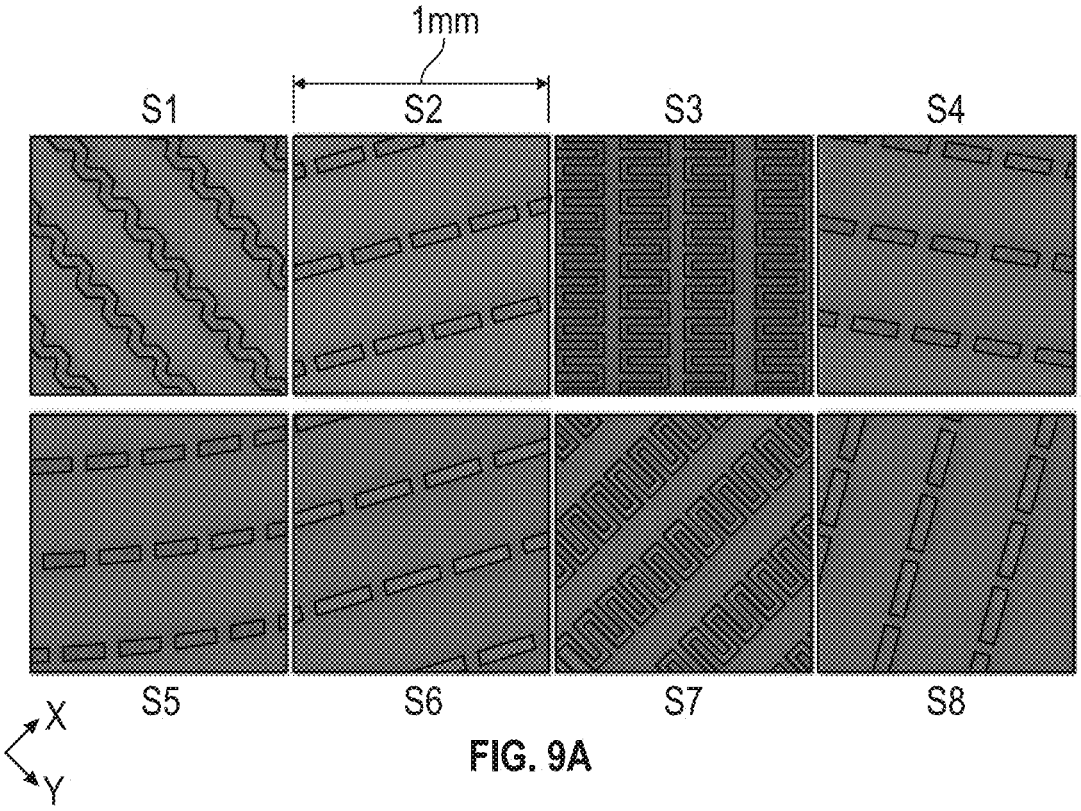
FIGS. 9A and 9B are illustrations of a cascaded sheet impedance polarizer in accordance with an embodiment of the invention fabricated using standard PCB processing techniques.
Figure 9B:
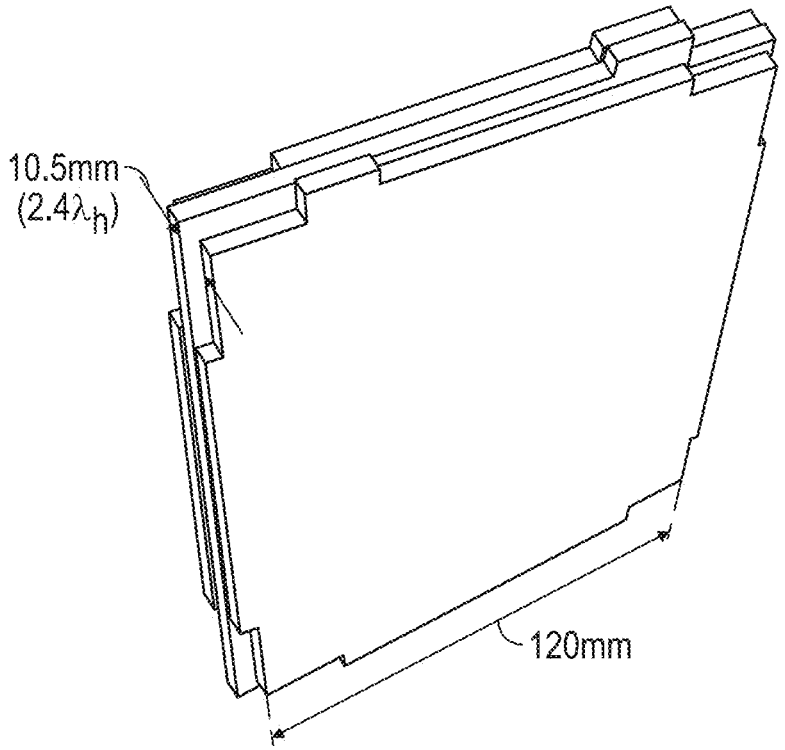

With reference now to FIGS. 9A and 9B, a cascaded sheet impedance polarizer is fabricated using standard PCB processing techniques. Each sheet is chemically etched and then bonded together. The fabricated sheets before bonding are shown in FIG. 9A, and the finished polarizer assembly after bonding and securing the impedance matching layers is depicted in FIG. 9B.

Figure 10A:
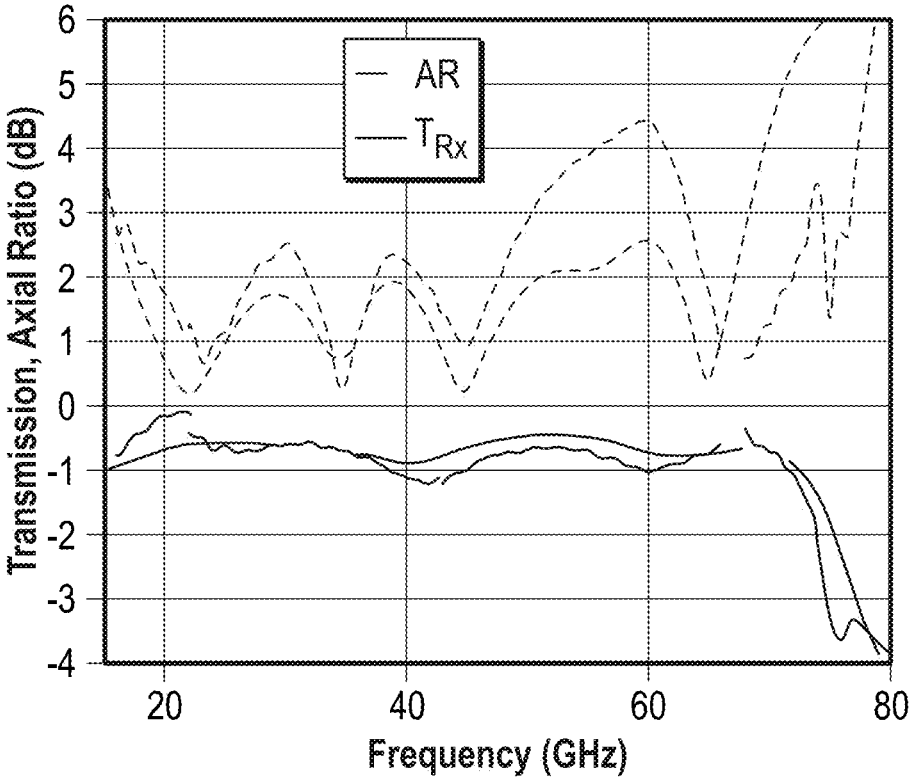
FIGS. 10A, 10B and 10C are graphs of the measured and simulated performance of the cascaded sheet impedance polarizer for various angles of incidence, where
Figure 10B:
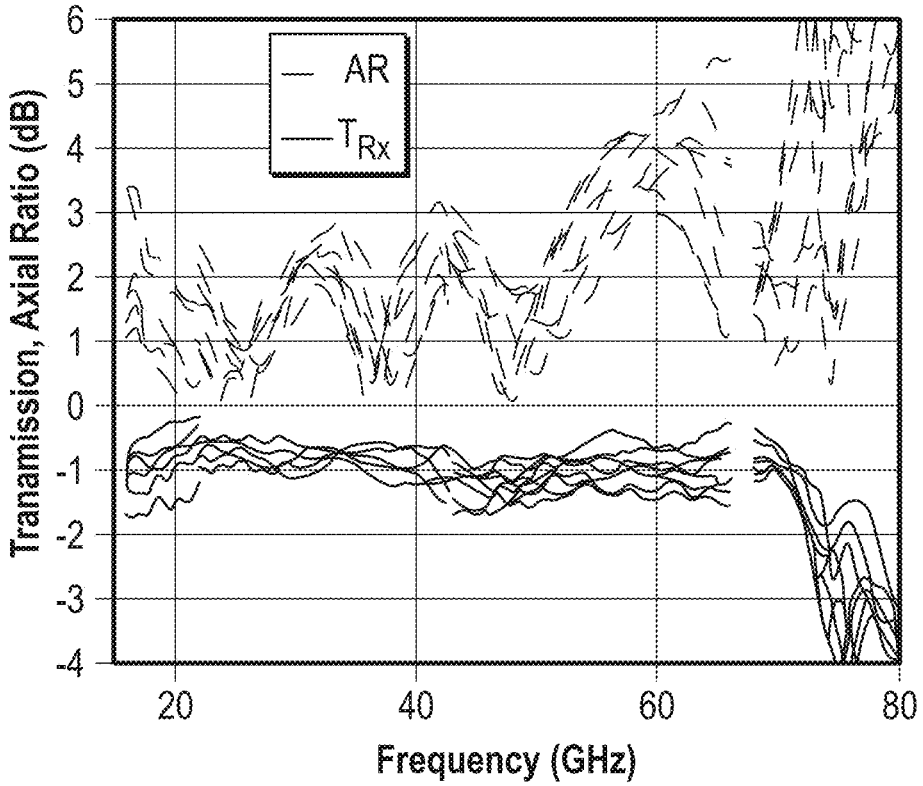
Figure 10C:
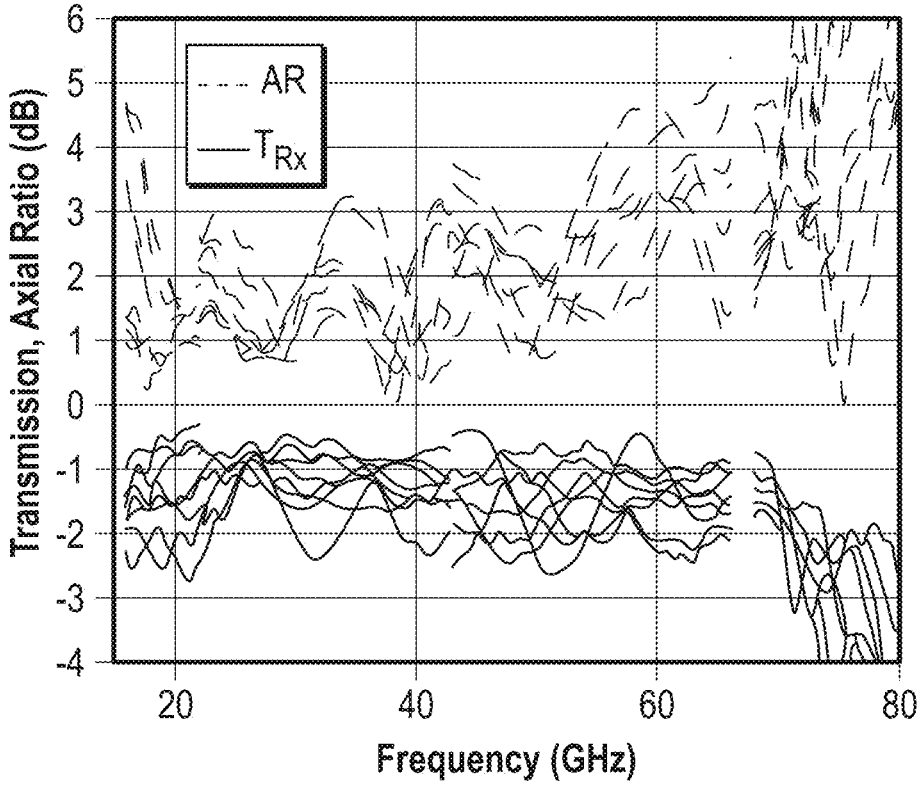

With reference to FIGS. 10A, 10B and 10C, the measured and simulated performance of the cascaded sheet impedance polarizer is depicted for various angles of incidence. FIG. 10A shows a normal incidence. The measured insertion loss is below approximately 1.5 dB between approximately 16 GHz and 73 GHz, and the axial ratio is below approximately 4.5 dB over this frequency range. There is reasonable agreement between simulation and measurement. The larger measured axial ratio at 60 GHz may be attributed to fabrication tolerances. The cascaded sheet impedance polarizer was also characterized at oblique angles of incidence (θ=45°, 60°), along the E, H, and diagonal planes (φ=0°, 45°, 90°, 135°, 180°, 225°, 270°, 315° planes). The performance only slightly degrades as the angle of incidence is increased to 45° from normal, as shown in FIG. 10B. At an angle of incidence of 60° from normal, the average insertion loss and axial ratio increases by roughly 1 dB compared to the broadside case as shown in FIG. 10C.

Figure 11:
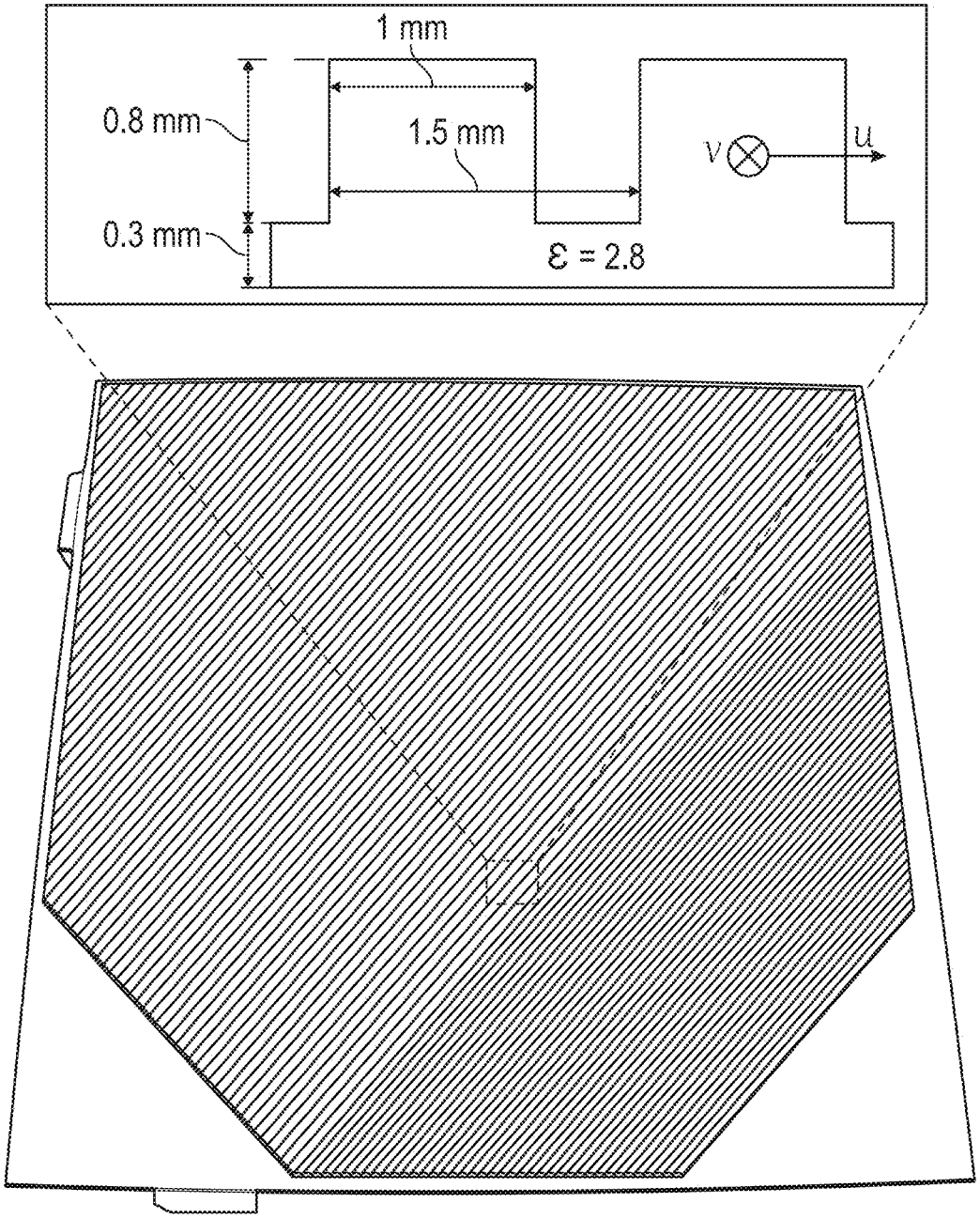
FIG. 11 depicts an embodiment of a polarizer in accordance with an embodiment of the invention having an additional anisotropic layer for improved performance.
Figure 12A:
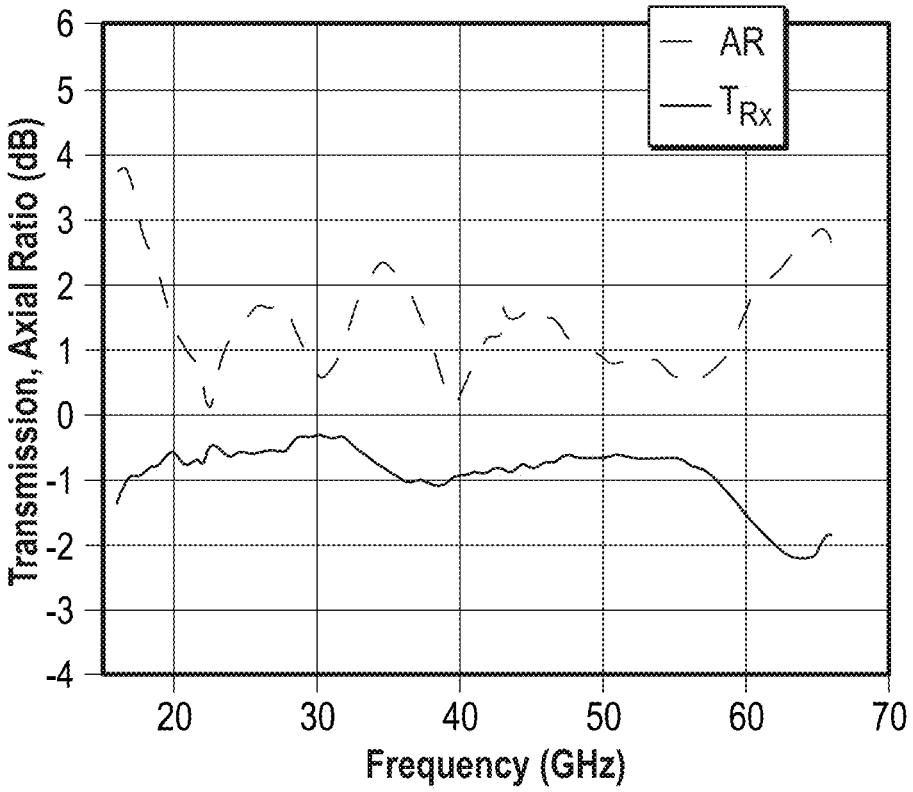
FIGS. 12A and 12B are graphs illustrating the measured performance of the polarizer of FIG. 11 at a normal angle of incidence and 60° scan angles.
Figure 12B:
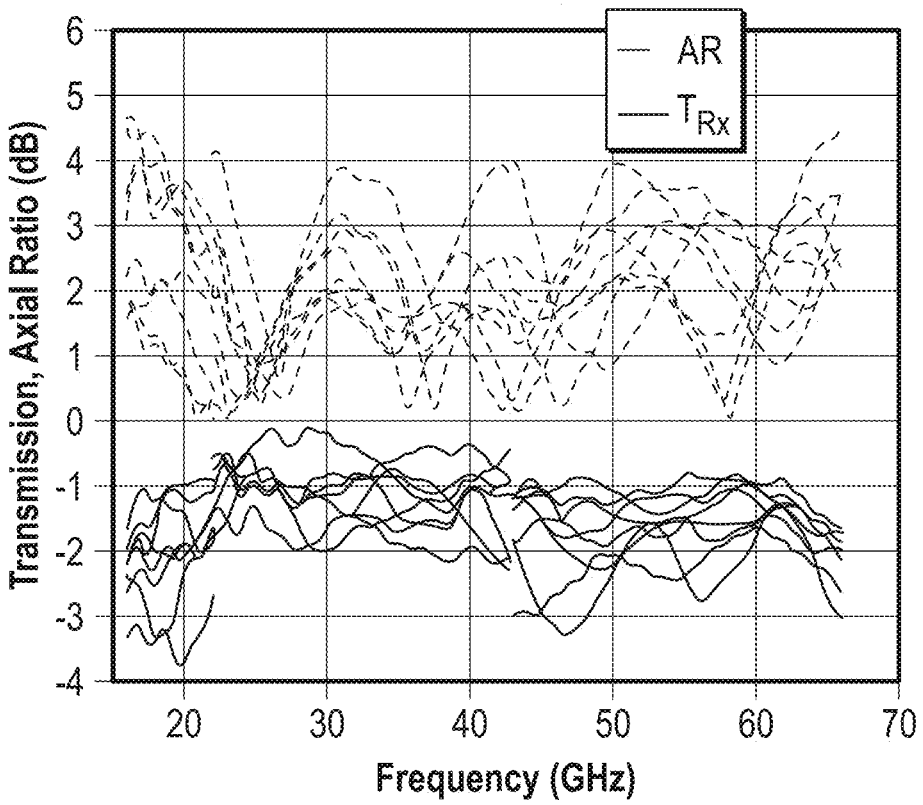

With reference now to FIG. 11, there is depicted an improved linear-to-circular polarizer in accordance with the invention that may be realized by adding an additional anisotropic layer to compensate for the higher axial ratio near 60 GHz. A 3D printed dielectric grating made from VeroWhite (ε=2.8) is embedded within the impedance matching layers (sandwiched between the ε=3 and ε=1.8 layers). A side view of the designed grating is shown in the inset. The grating generates a simulated relative phase shift difference of approximately 7° between the u and v polarizations at 60 GHz, which in turn brings the transmitted phase shift difference between x and y polarizations closer to the ideal 90° at the higher operating frequencies. The phase shift difference between u and v polarizations is directly proportional to the frequency. Therefore, the additional grating negligibly affects the performance at the lower operating frequencies. The measured performance at normal incidence and 60° scan angles is shown in FIGS. 12A and 12B. The presence of the dielectric grating keeps the axial ratio below approximately 3 dB from approximately 17 GHz to 66 GHz at normal angles of incidence (FIG. 12A). The polarizer's performance only marginally degrades when illuminated at wide scan angles such as shown in FIG. 12B.

Figure 13:
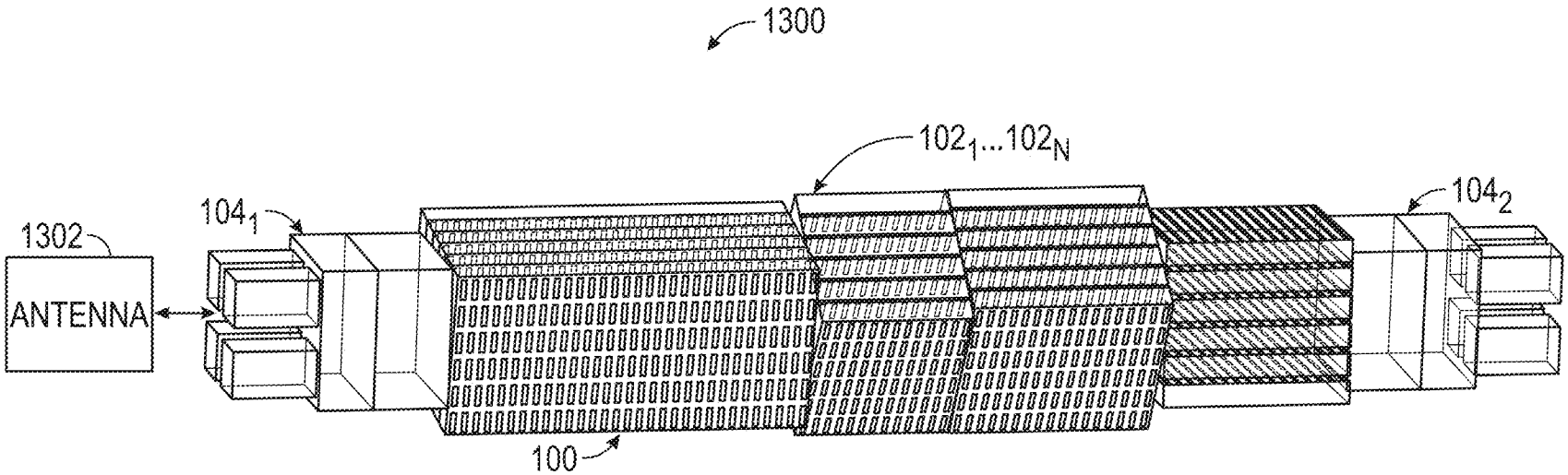
FIG. 13 is a schematic diagram of a linear-to-circular polarizer antenna assembly in accordance with an embodiment of the present invention.

FIG. 13 is a schematic diagram of a linear-to-circular polarizer antenna assembly 1300 in accordance with an embodiment of the present invention. The antenna assembly 1300 includes an antenna 1302 operable to transmit and receive polarized signals. The polarized signals may be linear signals transmitted or received at the antenna 1302 that are converted to circularly polarized signals for over-the-air communications, or circularly polarized signals that are converted to circularly polarized signals at the antenna 1302. The antenna assembly 1300 further includes a linear-to-circular polarizer 100 as described above, which is coupled to the antenna 1302. In one embodiment, the antenna 1302 is an electronically active scanning array (EASA).

Figure 14A:
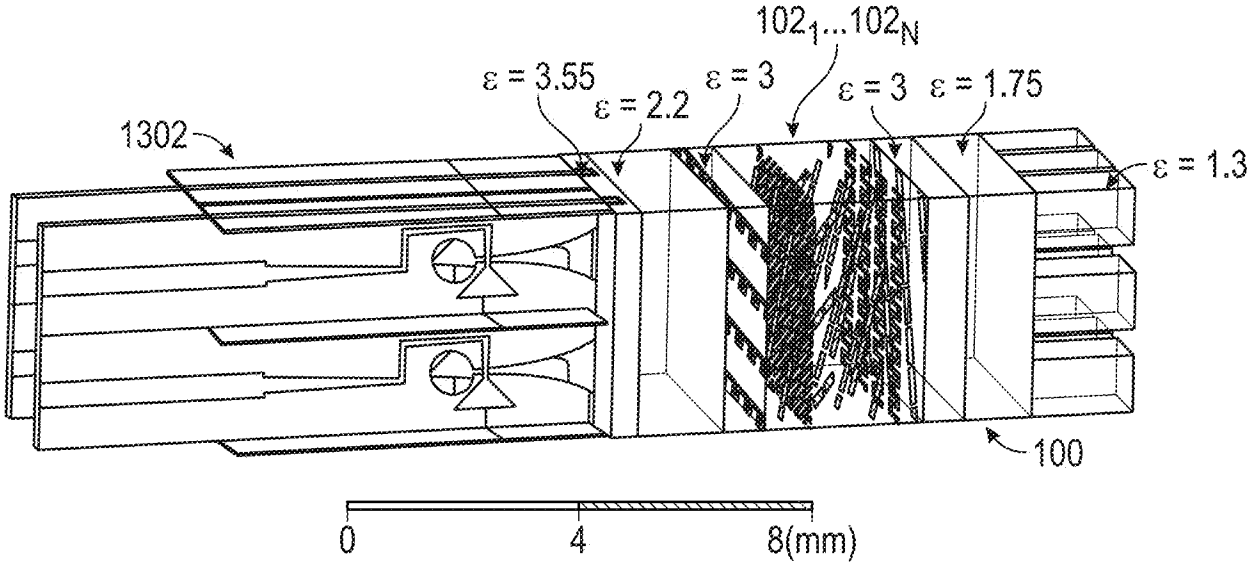
FIGS. 14A and 14B illustrate a schematic of a simulated structure of an example circularly polarized array employing dual-linear polarized antennas.
Figure 14B:
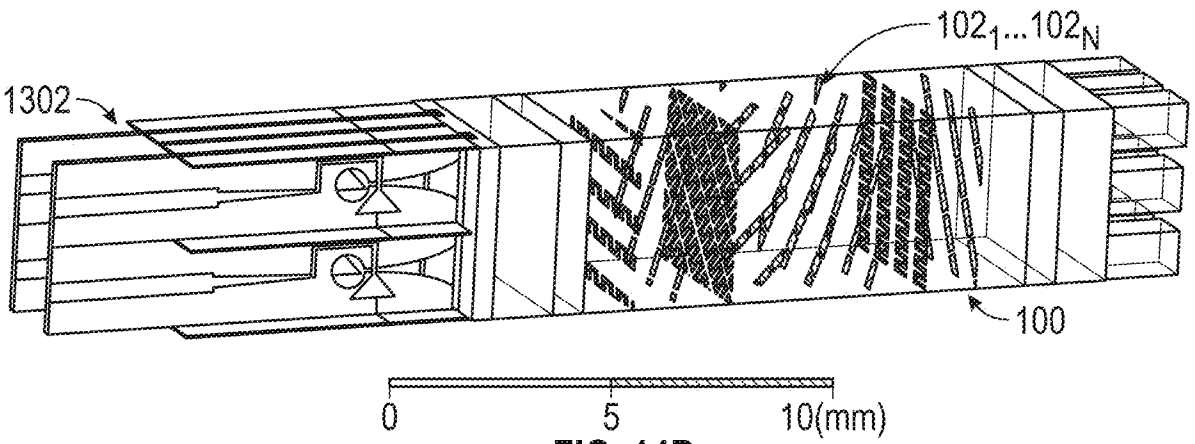

The geometry of a simulated linear-to-circular polarizer assembly consisting of a polarizer 100 and antenna 1302 is shown in the schematic of FIGS. 14A and 14B (an exploded view of FIG. 14A). In FIG. 14B, the cascaded metallic sheets $\mathbf{102}_1 \ldots \mathbf{102}_N$ are expanded by a factor of 3 in the z-direction for clarity. Since the different metallic layers of the linear-to-circular polarizer have different periodicities and orientations it is not possible to rigorously simulate the cascaded unit cell geometry using a full wave solver. Instead, the S-parameters of each component are cascaded together using the circuit solver in ANSYS HFSS®.

Figure 15:
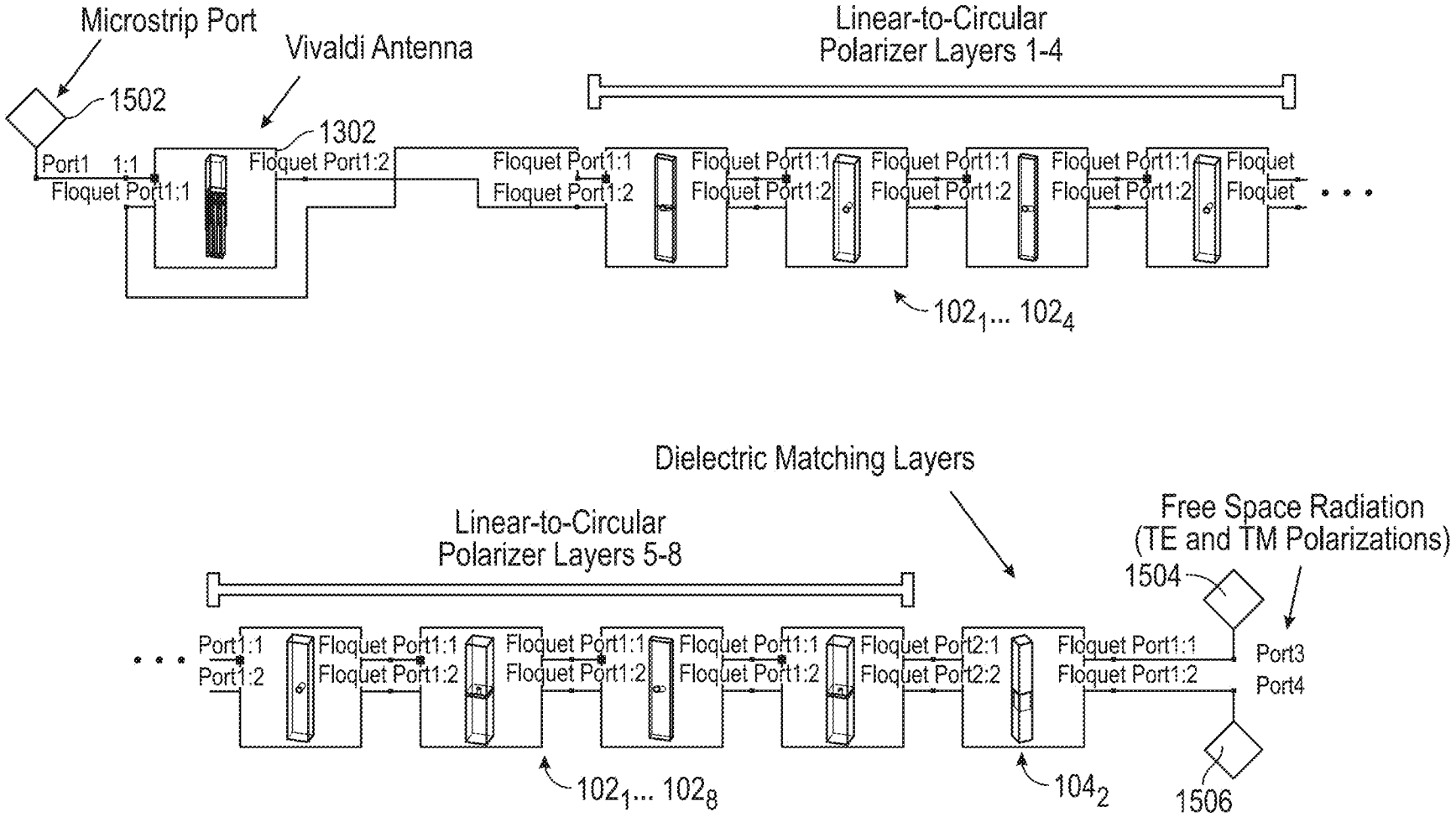
FIG. 15 is a high-level circuit diagram of cascaded components for modeling the performance of an embodiment in accordance with the present invention.

With reference to FIG. 15, there is depicted a circuit diagram 1500 of the cascaded components for modeling the performance of an embodiment in accordance with the present invention. The assembly 1500 includes a plurality of linear polarizer layers (cascaded metallic sheets $\mathbf{102}_1 \ldots \mathbf{102}_8$), dielectric matching layers (impedance matching layers $\mathbf{104}_2$), and a Vivaldi (co-planar broadband) antenna 1302. The antenna 1302 is coupled to a microstrip port 1502 on one side thereof and is coupled to the polarizer assembly 100 (consisting of cascaded metallic sheets $\mathbf{102}_1 \ldots \mathbf{102}_8$ and impedance matching layers $\mathbf{104}_2$) on the other side thereof. The transverse electric (TE) and transverse magnetic (TM) polarizations, 1504 and 1506, respectively are depicted schematically directly adjacent the impedance matching layers $\mathbf{104}_2$.

Figure 16A:
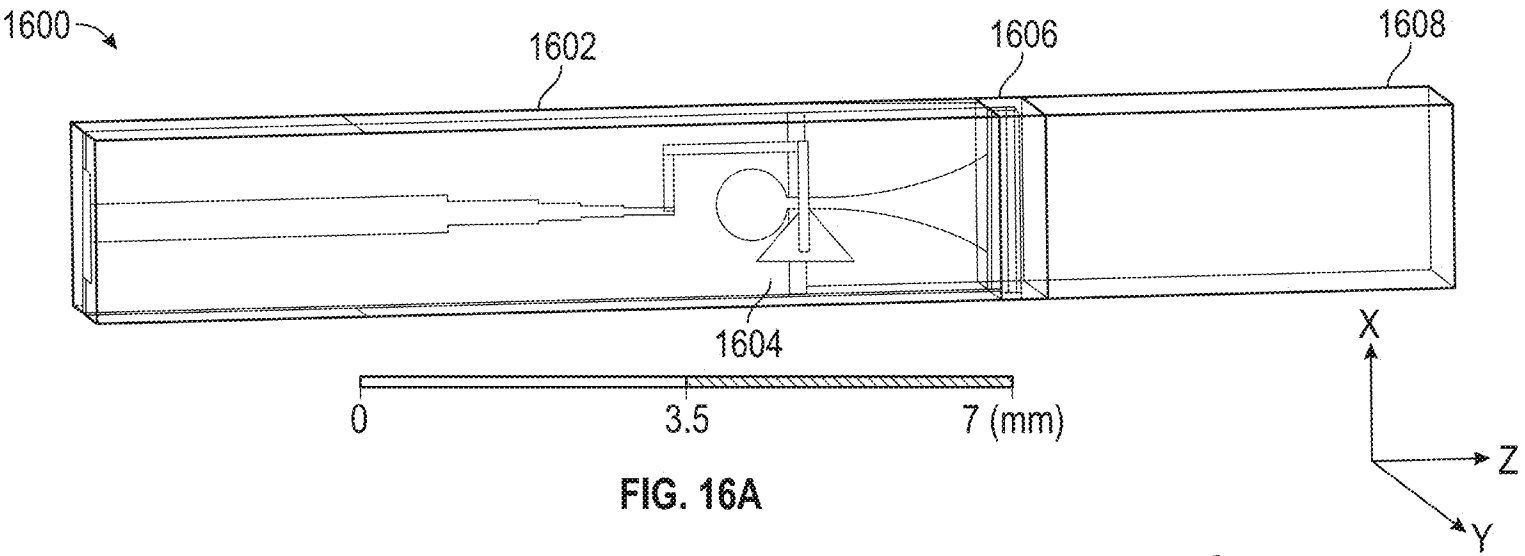
FIGS. 16A and 16B are two perspective schematic views of a unit cell of a linearly polarized antenna.
Figure 16B:
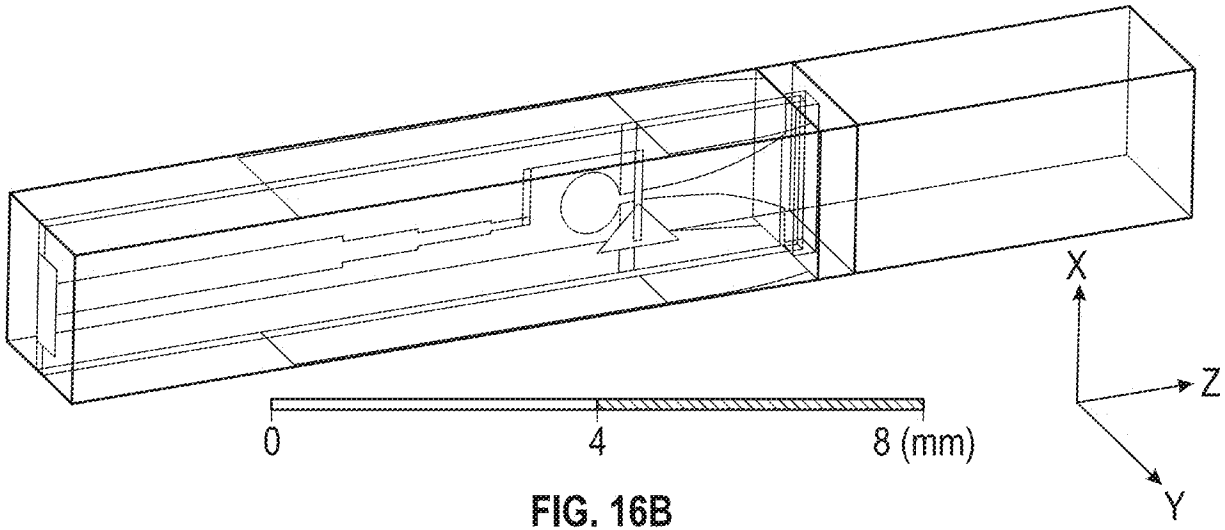

With reference to FIGS. 16A and 16B there is illustrated two perspective schematic views of a unit cell 1600 of the linearly polarized antenna. The depicted element 1600 is a short Vivaldi antenna (λ/2.5 long at the highest operating frequency). The short length improves the polarization purity when the antenna is scanned along the diagonal plane. An orthogonal metallic wall 1602 is placed at the top and bottom of the unit cell which improves the polarization purity further since the radiated wave sees a quasi-parallel-plate environment. The metallic wall is loaded with resistors 1604 to dissipate any energy that is reflected from the linear-to-circular polarizer into the orthogonal polarization (y-polarization). If the resistors are removed (or short circuited), reflections from the linear-to-circular polarizer degrade the polarization purity and generate undesired resonances when it is placed on top of the antenna. The antenna is designed to be impedance matched via a wide-angle impedance matching (WAIM) layer 1606 to a Rogers Duroid (ε=2.2) superstrate 1608. Of note, it is easier to impedance match the antenna to a lower impedance material (i.e., permittivity greater than unity) since its impedance is closer to the 50Ω port impedance of the input transmission line. However, placing a lower impedance material on top of the antenna does reduce the maximal operating frequency since surface waves can be excited at a lower frequency.

Figure 17:
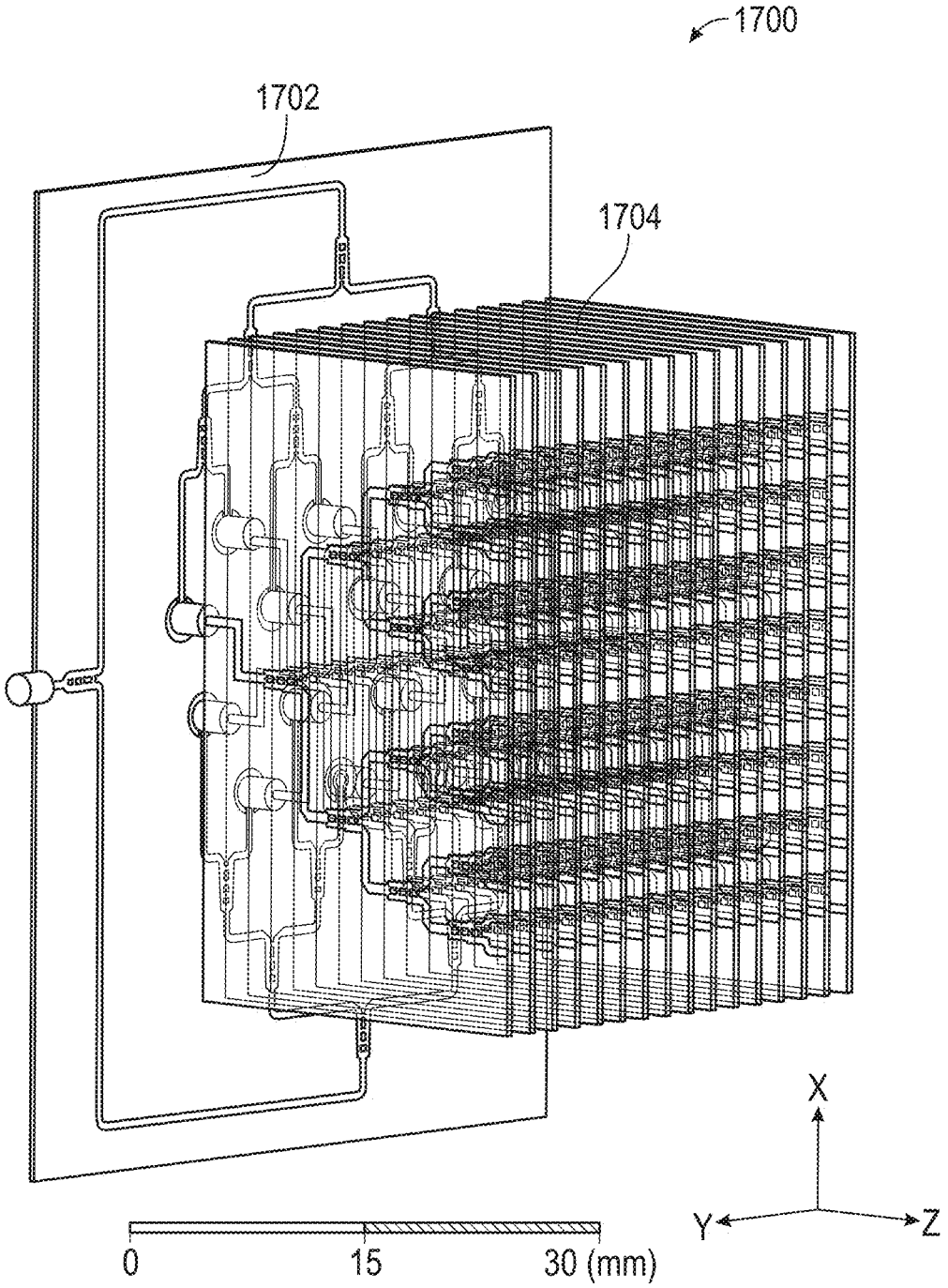
FIG. 17 is a schematic of a corporate beamformer in accordance with an embodiment of the present invention.

Referring now to FIG. 17, there is depicted a schematic of a corporate beamformer 1700 including microstrip feed lines 1702 behind the antenna that are connected to transmit-receive (TR) modules so that phase shifters, low noise amplifiers, power amplifiers, and switches can be integrated into every antenna element. The TR modules are combined in a manner such that signals at every antenna can be added coherently. There are many methods of combining the TR modules depending upon the number of desired channels for a particular application. In the depicted embodiment, every element is combined to a single port (i.e., single channel) via the corporate beamformer 1700. It should be noted that losses in the beamformer are less important than losses in the antenna and polarizer, since the TR modules are disposed between the beamformer and antennas. The illustrative beamformer 1700 is designed to feed a 256-element array (16×16 elements), but it will be understood that it can be easily modified to feed any number of elements (i.e., a power of 2). The beamformer 1700 consists of 8 cascaded Wilkinson power dividers 1704 of the type known in the art, where the power dividers are all identical. Each Wilkinson power divider utilizes 3 stages to provide a wide bandwidth, and for implementation purposes was optimized using ANSYS HFSS®.

Figure 18:
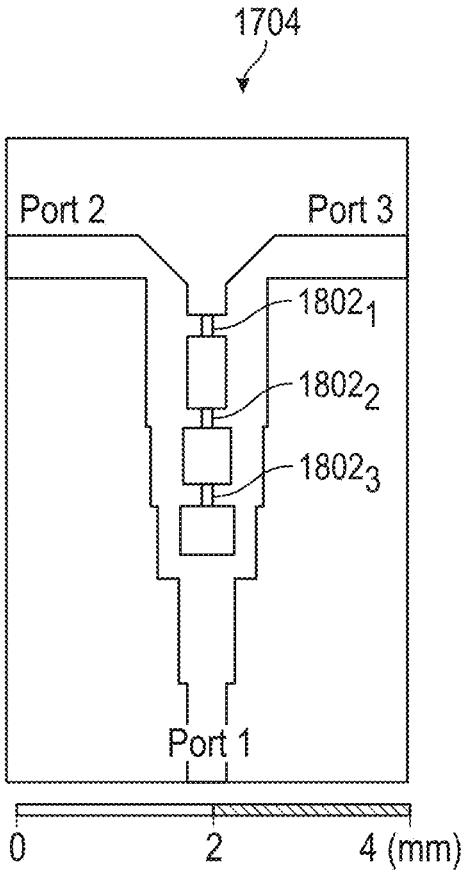
FIG. 18 is a schematic of a power divider that is part of the corporate beamformer of FIG. 17.
Figure 19:
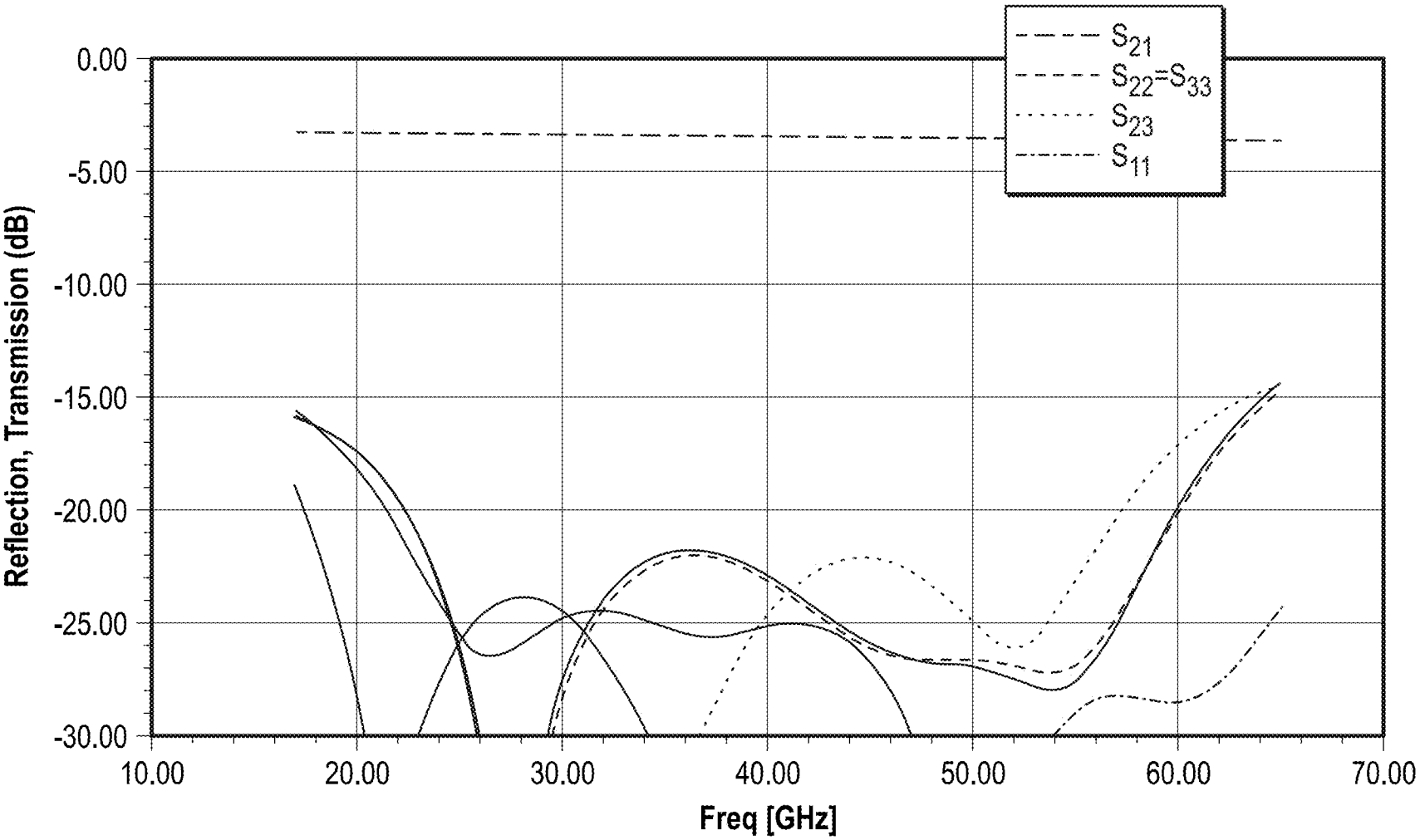
FIG. 19 is a graphical representation of the simulated performance of the power divider of FIG. 18.

A single power divider 1704 is shown schematically in FIG. 18, having 3 ports coupled to resistors $\mathbf{1802}_1$, $\mathbf{1802}_2$ and $\mathbf{1802}_3$. The performance of the power divider 1704 is graphically depicted in FIG. 19. The insertion loss of the power divider is 0.5 dB at 40 GHz, and the reflection coefficient at the input port is below −25 dB for most of the band. It is important to have a very good impedance match when many power dividers are cascaded together such as shown in FIG. 17, otherwise undesirable resonances between the cascaded power dividers can notably degrade performance. Simulations evidence that when the reflection coefficient of a single power divider is increased such that it is below −15 dB throughout the band, the input reflection coefficient of 4 cascaded power dividers reaches −6 dB at some frequencies.

Figure 20:
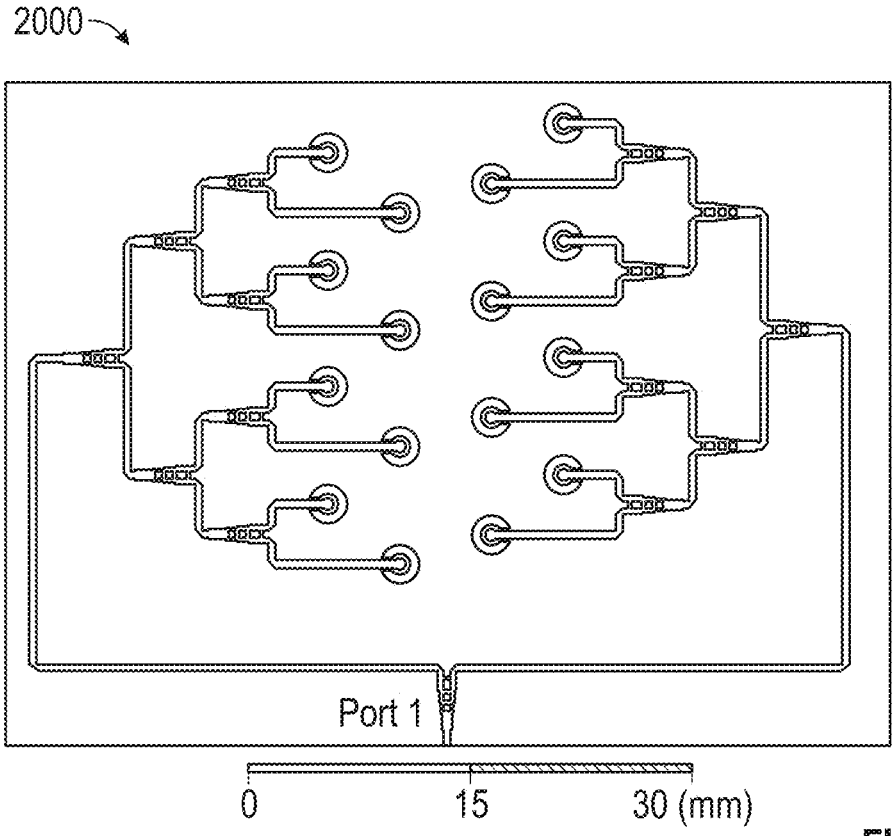
FIG. 20 is a schematic a first section of a feed network.
Figure 21:
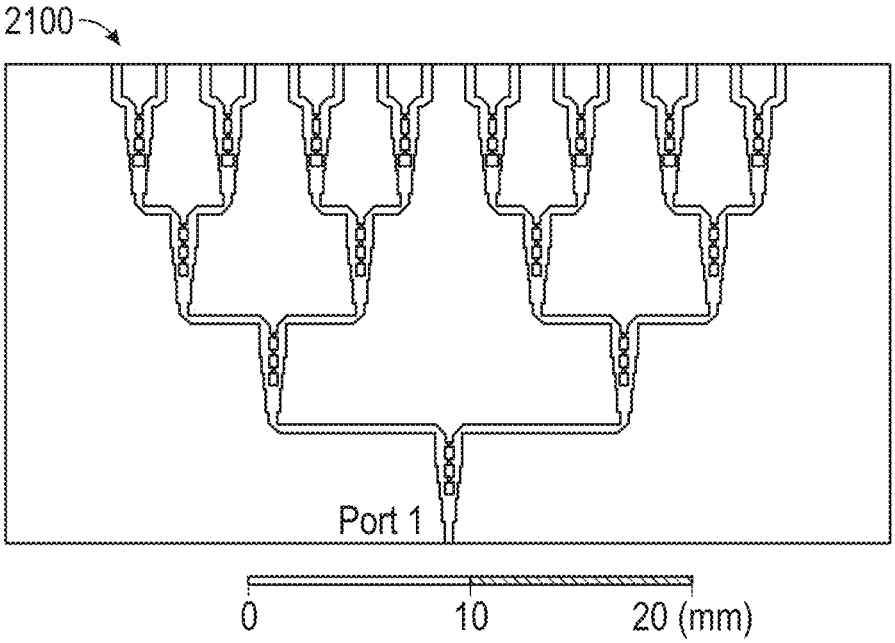
FIG. 21 is a schematic of a second section of a feed network.
Figure 22:
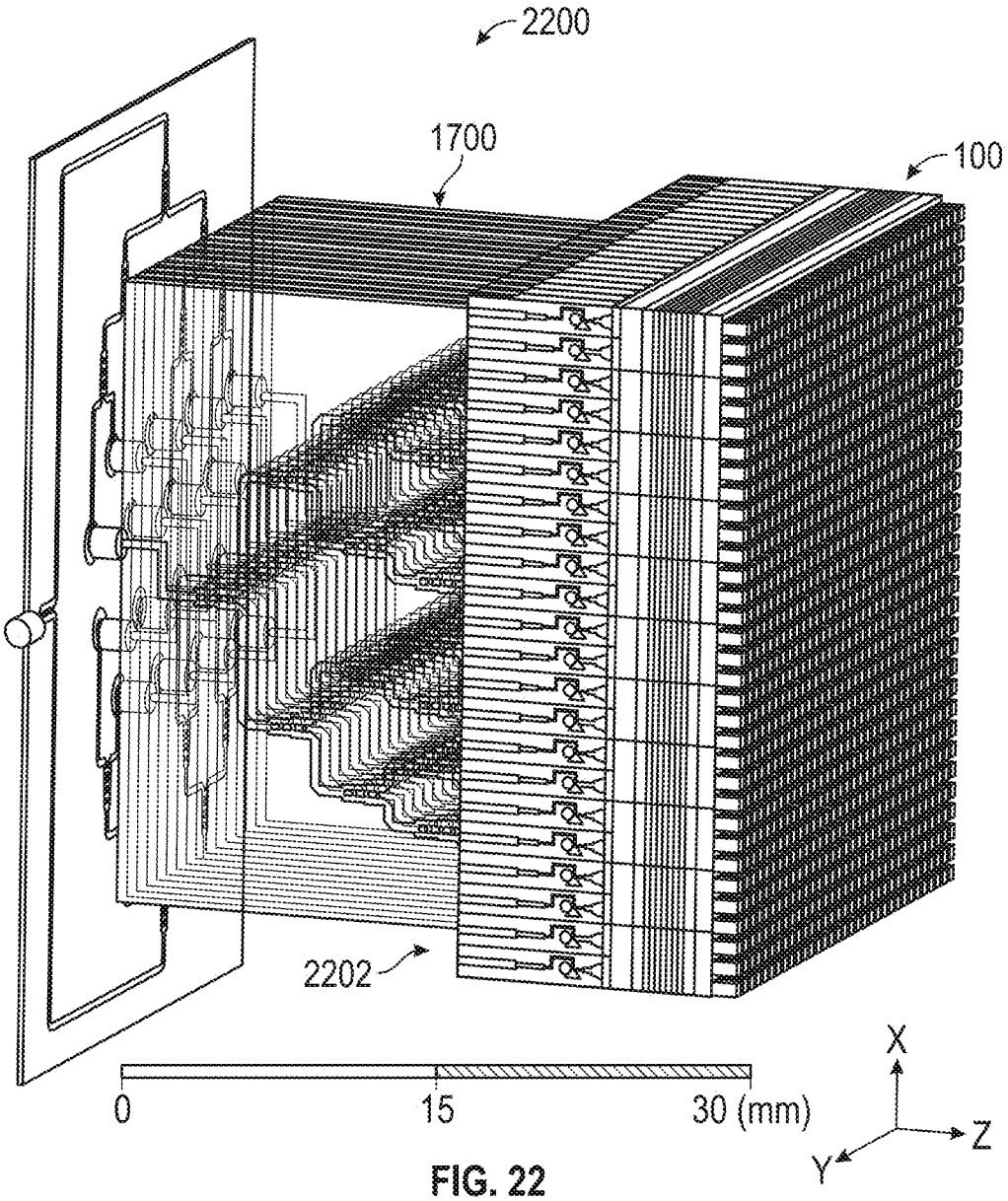
FIG. 22 is a perspective view of an array assembly in accordance with an embodiment of the present disclosure.
Figure 23A:
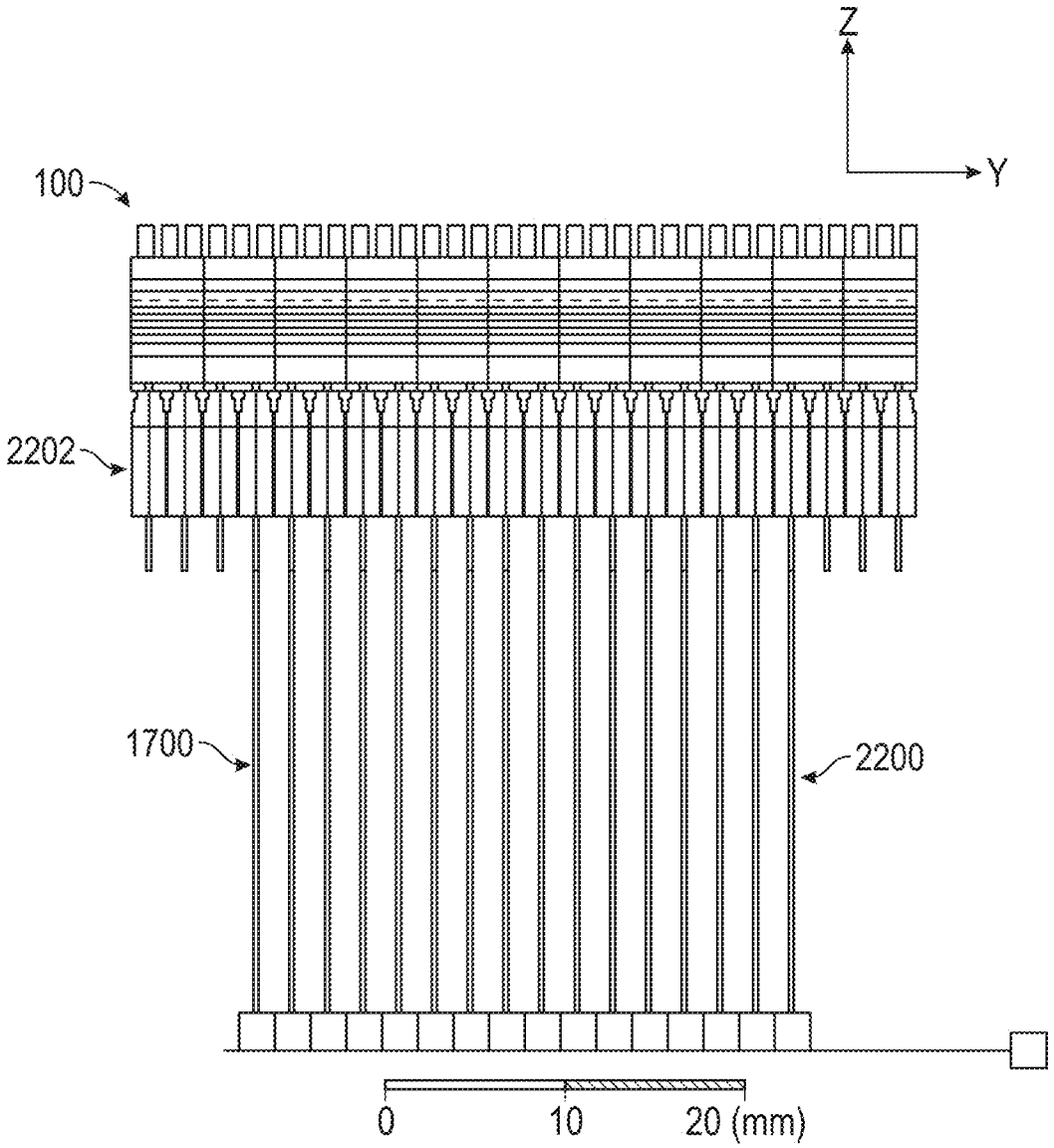
FIG. 23A is a top view of the array assembly of FIG. 22.
Figure 23B:
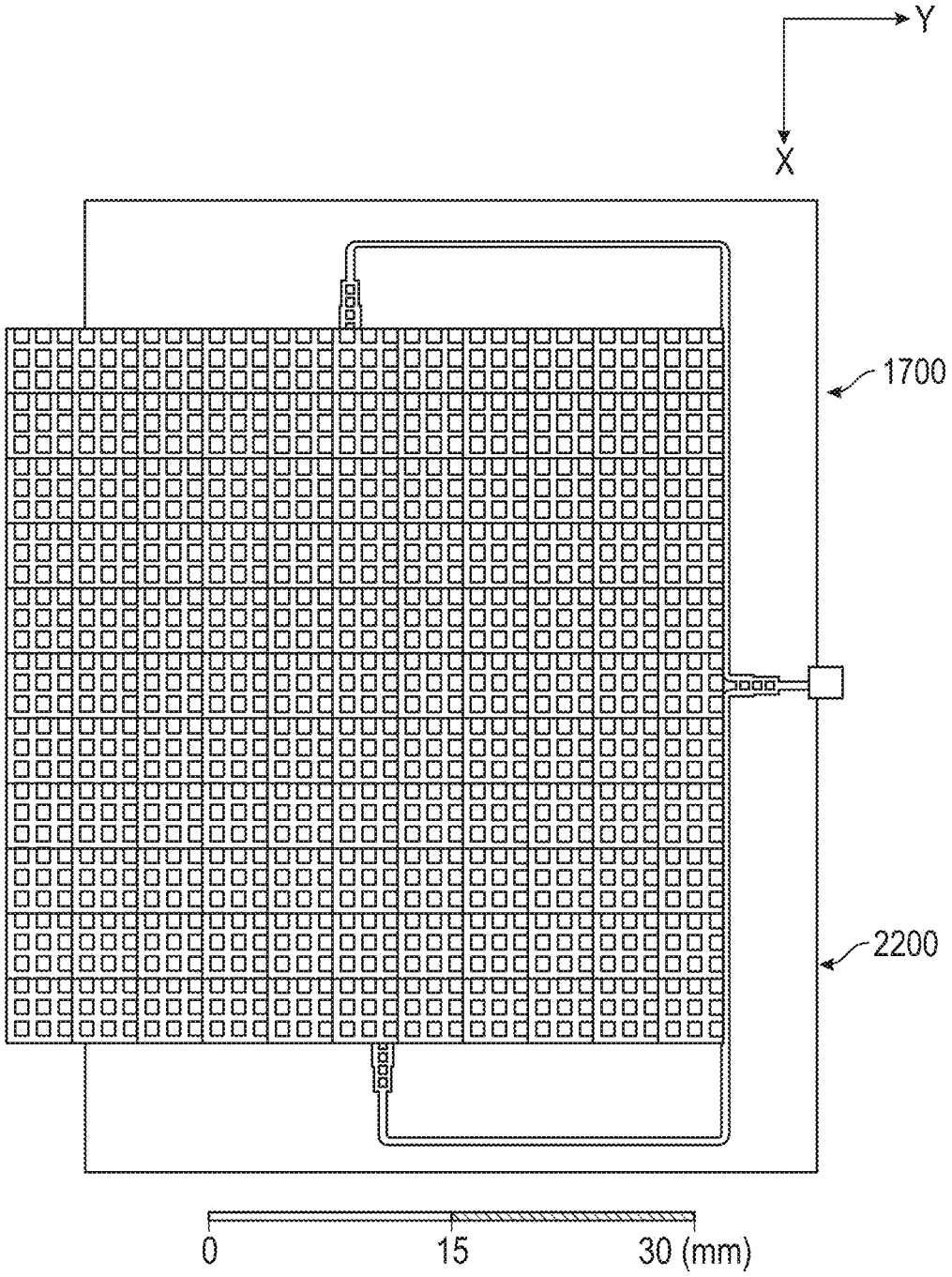
FIG. 23B is a front view thereof.
Figure 23C:
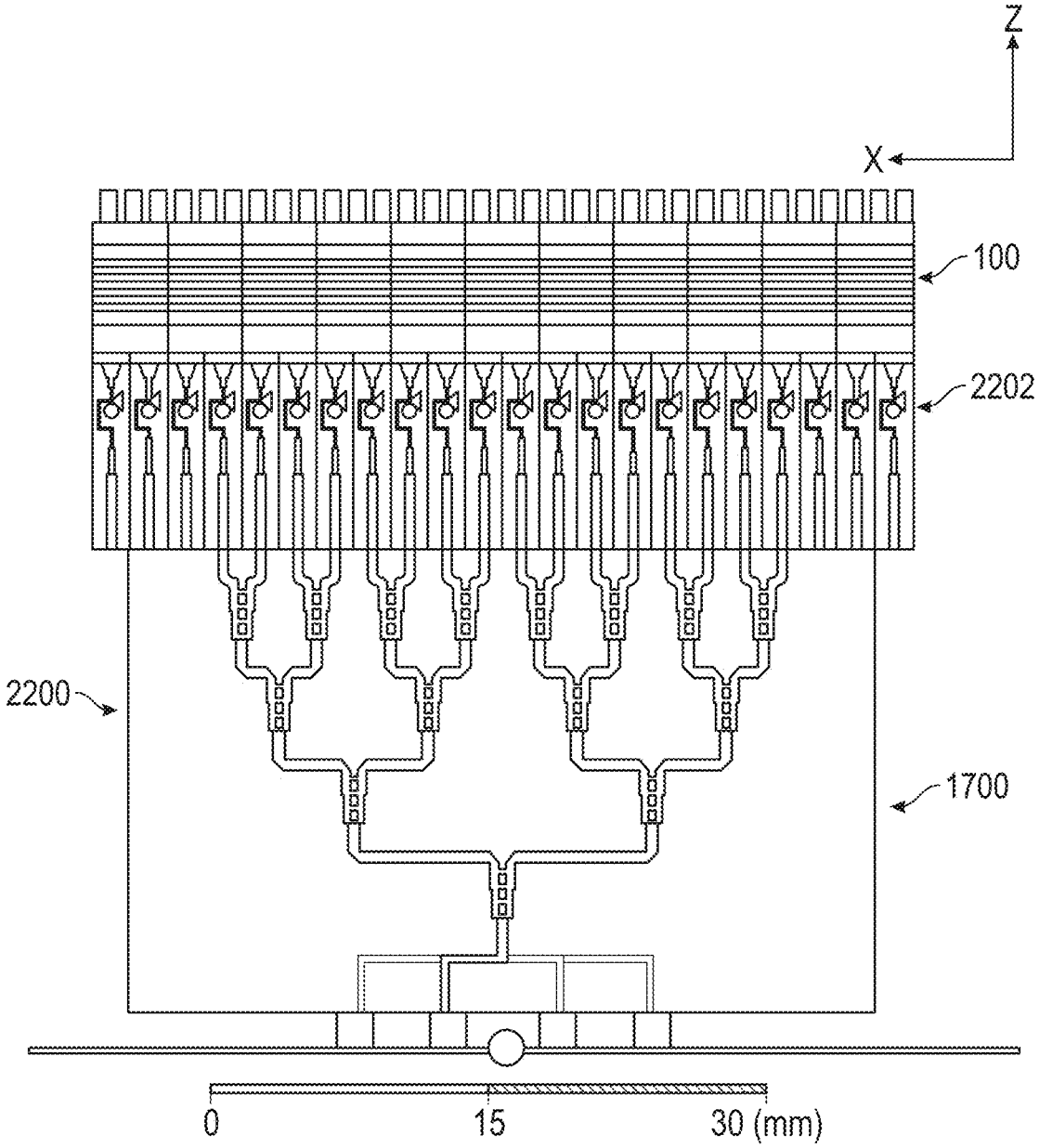
FIG. 23C is a side view thereof.

The feed network utilizes two different sections. The first section 2000 is depicted in FIG. 20, and is oriented in the xy plane shown in FIG. 17. This section is a 1:16 power divider that feeds each column of the array. The second section 2100 is illustrated in FIG. 21, and consists of 16 different columns, each having 1:16 power dividers. The two different sections are coupled together using SMPM (i.e., GPP0) connectors. The 16 output ports of the first section are staggered to provide additional space for the SMPM connectors.

FIGS. 22, 23A, 23B and 23C are a perspective view, a top view, a front view, and a side view of an assembly 2200 in accordance with an embodiment of the invention. The assembly 2200 is composed of an antenna array integrated with a corporate feed network 1700 and linear-to-circular polarizer 100. The TR modules are shown at 2202. The illustrative configuration employs 3 dummy cells at every edge of the array to reduce truncation effects. The presence of the dummy cells doubles the area occupied by the array.

Figure 24:
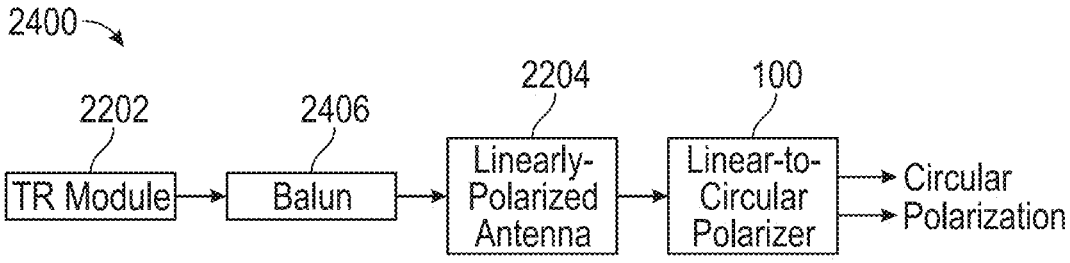
FIG. 24 is a high-level schematic of an architecture for an AESA in accordance with an embodiment of the present invention.

Referring now to FIG. 24, there is illustrated a high-level schematic of an architecture 2400 for an AESA in accordance with an embodiment of the present invention. In this architecture 2400, the antenna complexity is functionally divided into two areas: the linearly polarized feed composed of the TR module 2202, which feeds the linearly polarized antenna 2404 via a Balun 2406. The linearly polarized antenna 2404 converts signals to circular polarization via the linear-to-circular polarizer 100.

Figure 25:
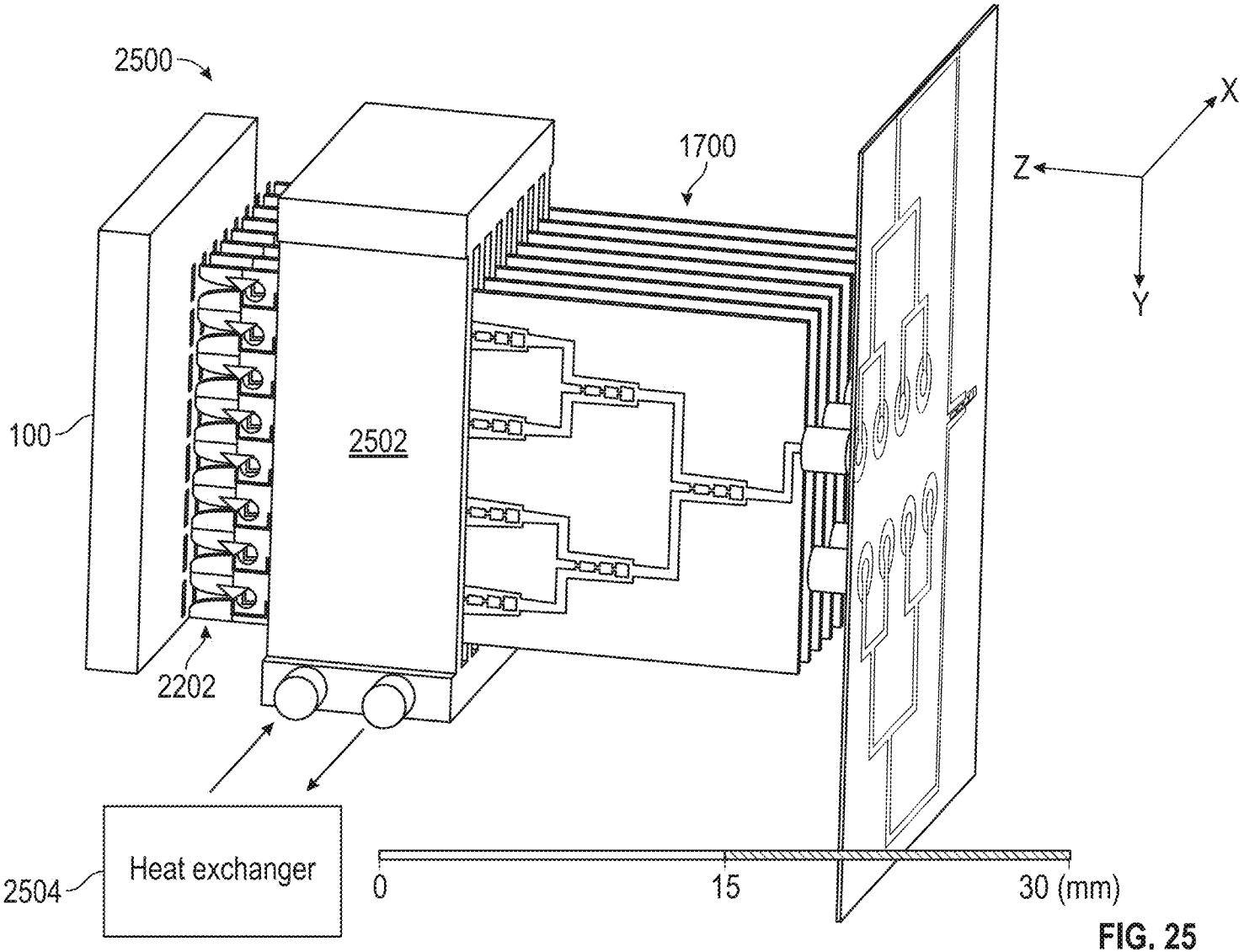
FIG. 25 is an illustration of an AESA assembly having a liquid cooling manifold in accordance with an embodiment of the present invention.

FIG. 25 is an illustration of an AESA assembly 2500 that incorporates a liquid cooling manifold 2502 in accordance with an embodiment of the present invention. The assembly 2500 includes the corporate beamformer 1700, TR modules 2202 and linear-to-circular polarizer 100 as described above. A heat exchanger 2504 is fluidly coupled to the liquid cooling manifold for dissipating heat from the system as a liquid coolant flows through the heat exchanger 2504 in a conventional manner.

Figure 26:
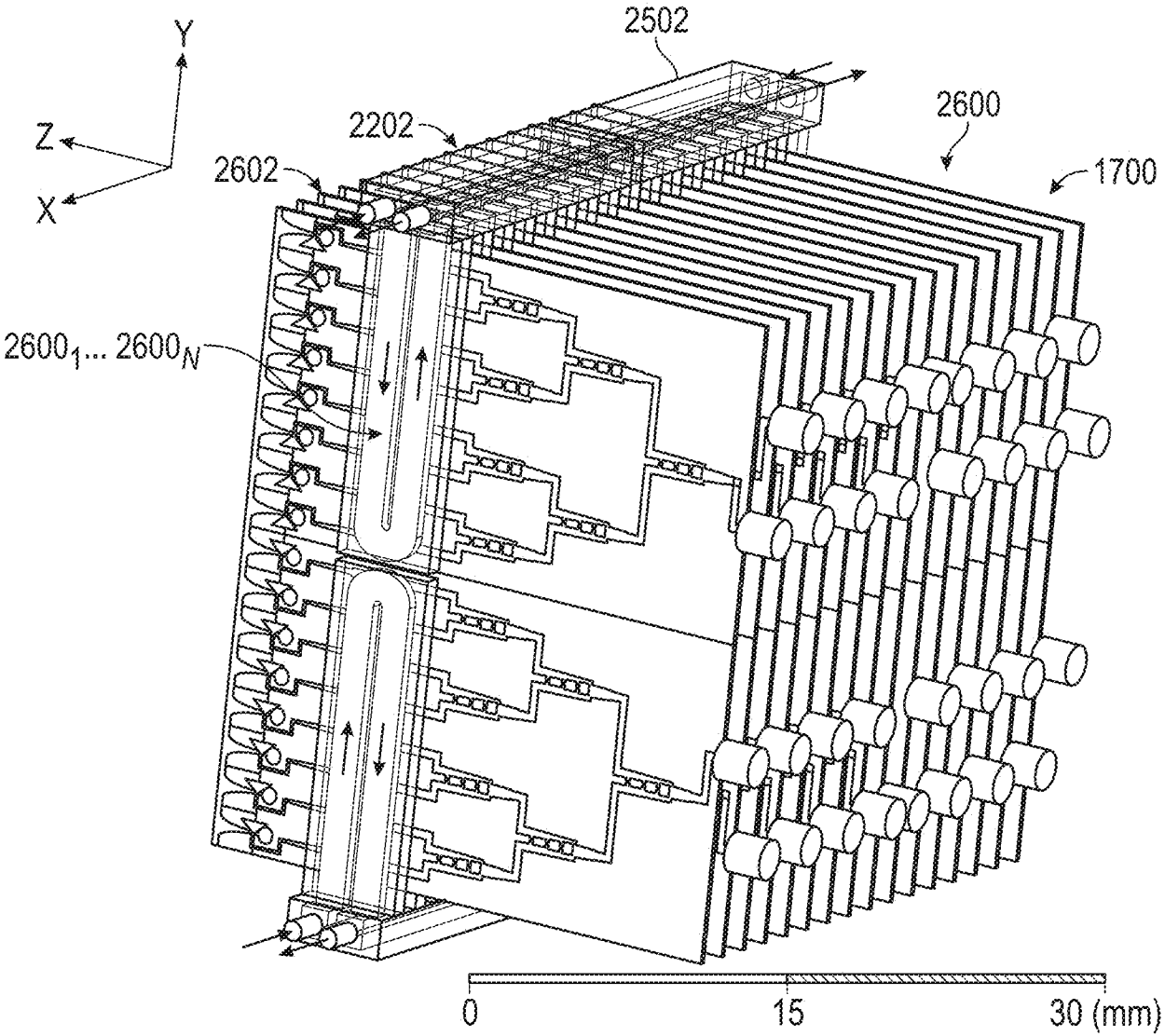
FIG. 26 is another view of the AESA assembly of FIG. 25.

FIG. 26 is another view of the AESA assembly 2500 of FIG. 25, showing the liquid manifold 2502 positioned with respect to the TR modules 2202. In this expedient, the cooling manifold 2502 is configured with a plurality of distributed U-shaped cooling ducts $\mathbf{2600}_1 \ldots \mathbf{2600}_N$ that permit the flow of coolant to remove heat from the TR modules 2202 during operation. The cooling ducts are disposed between cascaded PCBs 2602 as shown.

Figure 27:
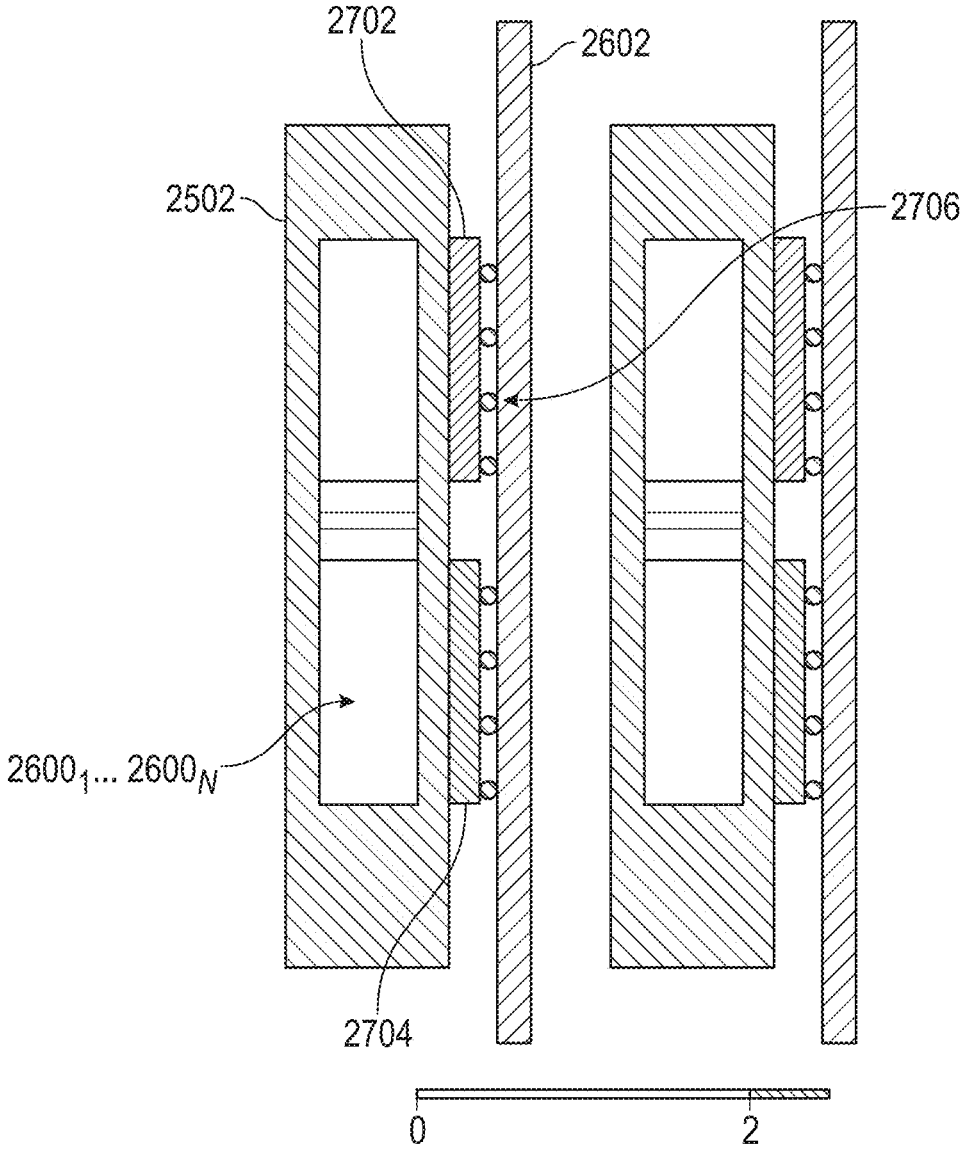
FIG. 27 a zoomed-in section view of the TR modules connected to printed circuit boards (PCBs) in a flip-chip assembly.

FIG. 27 is a zoomed-in section view of the TR modules 2202 connected to the PCBs 2602 in a flip-chip assembly which exposes the backside of the TR modules to the cooling manifold 2502. The separation between the liquid ducts $\mathbf{2600}_1 \ldots \mathbf{2600}_N$ and the TR module 2202 is made as thin as possible given manufacturing and mechanical tolerances (roughly 0.1 mm) to maximize the thermal conductivity. The TR module 2202 has two monolithic-microwave integrated circuits (MMICs). A first MMIC 2702, which is closest to the radiating element, is constructed from GaN, which enables higher performance switches, low-noise amplifiers, and power amplifiers. The second MMIC 2704 is constructed from SiGe. Flip-flop solder bumps 2706 are disposed between the MMICs 2702, 2704 and the respective PCBs 2602.

Figure 28:
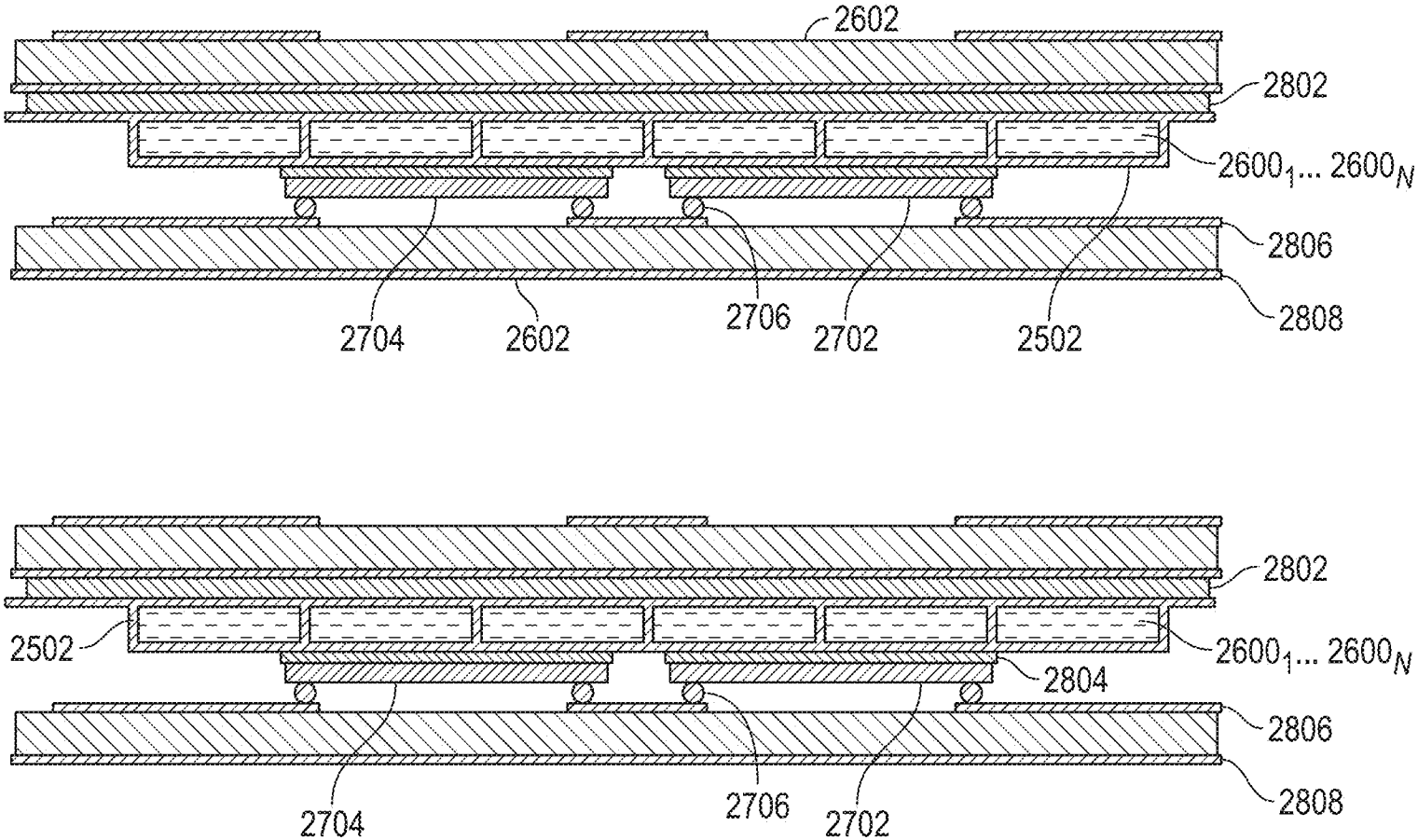
FIG. 28 is a cross-sectional view of the PCBs, TR module, flip-chip solder bumps and liquid cooling ducts of the cooling manifold in accordance with an embodiment of the present invention.

With reference now to FIG. 28, there is depicted a cross-sectional view of the PCBs 2602, TR modules 2202, flip-chip solder bumps 2706, and liquid cooling ducts $\mathbf{2600}_1 \ldots \mathbf{2600}_N$ of the cooling manifold 2502. The rough thicknesses of the different sections for a 20-60 GHz array are listed. An RF absorber-filler 2802 is located between the liquid cooling ducts $\mathbf{2600}_1 \ldots \mathbf{2600}_N$ and the PCBs 2602. A high-thermal adhesive layer 2804 bonds the GaN/SiGe MMICs to the liquid cooling ducts $\mathbf{2600}_1 \ldots \mathbf{2600}_N$. A microstrip line 2806 is disposed between the PCBs 2602 and flip-chip solder bumps 2706. A PCB ground layer 2808 is coupled to each PCB 2602 as depicted in the drawing.

It will be appreciated that the devices and methods of fabrication disclosed in accordance with embodiments of the invention are set forth by way of example and not of limitation. Absent an explicit indication to the contrary, the disclosed devices, systems, and method steps may be modified, supplemented, omitted, and/or re-ordered without departing from the scope of this invention. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

It will be understood by those skilled in the art that various changes may be made in the form and details of the described embodiments resulting in equivalent embodiments that remain within the scope of the appended claims.

What is claimed is:

1. An active electronically scanned array, comprising:
a linear-to-circular polarizer coupled to a radiating aperture;
one or more transmit-receive modules coupled to radiating elements; and
a plurality of distributed liquid cooling ducts disposed adjacent the one or more transmit-receive modules.

2. The active electronically scanned array of claim 1, further comprising one or more cooling manifolds, each cooling manifold having the plurality of distributed liquid cooling ducts.

3. The active electronically scanned array of claim 2, where the one or more cooling manifolds are bonded to one or more of the transmit-receive modules.

4. The active electronically scanned array of claim 2, where the linear-to-circular polarizer, one or more transmit-receive modules and one or more cooling manifolds are configured in a stacked arrangement.

5. The active electronically scanned array of claim 4, where one or more transmit-receive modules are connected in a flip-chip assembly.

6. The active electronically scanned array of claim 2, further comprising a heat exchanger fluidly coupled to the one or more cooling manifolds.

7. The active electronically scanned array of claim 1, further comprising a plurality of linearly polarized radiating elements, where each radiating element is coupled to a printed circuit board column.

8. The active electronically scanned array of claim 1, where a plurality of layers of printed circuit boards are coupled to the radiating aperture.

9. The active electronically scanned array of claim 8, where the cooling ducts are disposed between the printed circuit boards.

10. The active electronically scanned array of claim 1, where the linear-to-circular polarizer, comprises:
a plurality of cascaded waveplates having biaxial permittivity, each waveplate having a principal axis rotated at different angles relative to an adjacent waveplate about a z-axis of a 3-dimensional x, y, z coordinate system; and
impedance matching layers disposed adjacent the cascaded waveplates.

11. An active electronically scanned array, comprising:
a linear-to-circular polarizer coupled to a radiating aperture;
one or more transmit-receive modules coupled to the radiating elements; and
one or more cooling manifolds coupled to the one or more transmit-receive modules and including a plurality of distributed liquid cooling ducts disposed in spaces between a plurality of adjacent printed circuit boards.

12. The active electronically scanned array of claim 11, where the one or more cooling manifolds are bonded to one or more of the transmit-receive modules.

13. The active electronically scanned array of claim 12, where the linear-to-circular polarizer, one or more transmit-receive modules and one or more cooling manifolds are configured in a stacked arrangement.

14. The active electronically scanned array of claim 13, where the linear-to-circular polarizer, one or more transmit-receive modules are connected in a flip-chip assembly.

15. The active electronically scanned array of claim 12, further comprising a heat exchanger fluidly coupled to the one or more cooling manifolds.

16. The active electronically scanned array of claim 11, further comprising a plurality of linearly polarized radiating elements, where each radiating element is coupled to a printed circuit board column.

17. The active electronically scanned array of claim 11, where a plurality of layers of printed circuit boards are coupled to the radiating aperture.

18. An active electronically scanned array, comprising:
a linear-to-circular polarizer coupled to a radiating aperture, the linear to circular polarizer comprising:
a plurality of cascaded waveplates having biaxial permittivity, each waveplate having a principal axis rotated at different angles relative to an adjacent waveplate about a z-axis of a 3-dimensional x, y, z coordinate system; and
impedance matching layers disposed adjacent the cascaded waveplates;
one or more transmit-receive modules coupled to the radiating elements; and
one or more cooling manifolds coupled to the one or more transmit-receive modules and including a plurality of distributed liquid cooling ducts disposed in spaces between a plurality of adjacent printed circuit boards.

19. An active electronically scanned array, comprising:
a linear-to-circular polarizer coupled to a radiating aperture, the linear to circular polarizer comprising:
a plurality of cascaded anisotropic sheets, each sheet having a principal axis rotated at different angles relative to an adjacent sheet about a z-axis of a 3-dimensional x, y, z coordinate system; and
impedance matching layers disposed adjacent the cascaded sheets; and
one or more transmit-receive modules coupled to the radiating elements; and
one or more cooling manifolds coupled to the one or more transmit-receive modules and including a plurality of distributed liquid cooling ducts disposed in spaces between a plurality of adjacent printed circuit boards.

* * * * *